US008161890B2

(12) United States Patent
Wang

(10) Patent No.: US 8,161,890 B2
(45) Date of Patent: Apr. 24, 2012

(54) FOLDABLE TABLE FOR NOTEBOOK-COMPUTER

(75) Inventor: Qunpu Wang, Jilin (CN)

(73) Assignee: Shenzhen Jinhaifan Technology Co., Ltd, Shenzhen (CN)

( * ) Notice: Subject to any disclaimer, the term of this patent is extended or adjusted under 35 U.S.C. 154(b) by 259 days.

(21) Appl. No.: 12/595,731

(22) PCT Filed: Apr. 11, 2008

(86) PCT No.: PCT/CN2008/070702

§ 371 (c)(1),
(2), (4) Date: Jan. 21, 2010

(87) PCT Pub. No.: WO2008/125055

PCT Pub. Date: Oct. 23, 2008

(65) Prior Publication Data

US 2010/0158300 A1 Jun. 24, 2010

(30) Foreign Application Priority Data

Apr. 13, 2007 (CN) ..... 2007 2 0119430 U

(51) Int. Cl.
*A47F 5/12* (2006.01)

(52) U.S. Cl. ..... 108/6; 108/115

(58) Field of Classification Search ..... 108/1, 6, 108/3, 7, 23, 50.01, 50.02, 50.13, 115; 248/188.6, 248/166

See application file for complete search history.

(56) References Cited

U.S. PATENT DOCUMENTS

| | | | | |
|---|---|---|---|---|
| 1,051,983 | A * | 2/1913 | Brown | 108/50.13 |
| 2,449,492 | A * | 9/1948 | Long | 248/454 |
| 3,640,228 | A * | 2/1972 | Busse | 108/6 |
| 4,099,469 | A * | 7/1978 | Sahli | 108/1 |
| 4,196,675 | A * | 4/1980 | Cook | 108/6 |
| 4,248,161 | A * | 2/1981 | Adair et al. | 108/6 |
| 4,383,486 | A * | 5/1983 | Reineman et al. | 108/6 |
| 4,654,762 | A * | 3/1987 | Laverick | 108/23 |
| 4,714,224 | A * | 12/1987 | Calmes | 108/10 |
| 5,116,011 | A * | 5/1992 | Smith | 108/23 |
| 5,943,965 | A | 8/1999 | Riach et al. | |
| 6,019,050 | A * | 2/2000 | Ranta | 108/6 |
| 7,878,128 | B2 * | 2/2011 | Watson et al. | 108/115 |
| 7,942,101 | B2 * | 5/2011 | Conley | 248/188.6 |
| 2003/0188672 | A1 | 10/2003 | Parent et al. | |
| 2005/0006931 | A1 | 1/2005 | Meskill et al. | |
| 2007/0012827 | A1 | 1/2007 | Fu et al. | |

FOREIGN PATENT DOCUMENTS

| | | |
|---|---|---|
| CN | 86 202 133 | 3/1987 |
| CN | 2 103 943 | 5/1992 |
| CN | 1 729 889 | 2/2006 |
| CN | 2 776 142 | 5/2006 |

* cited by examiner

*Primary Examiner* — Jose V Chen
(74) *Attorney, Agent, or Firm* — Fay Kaplun & Marcin, LLP

(57) ABSTRACT

A foldable table for a notebook computer comprises a table top (1), a cross beam tube (4) and a pair of foldable supporting frames (2, 3) provided at left and right ends of the cross beam tube (4). The cross beam tube (4) is movably and co-axially connected to a pair of lugs which are fixedly connected to the table top (1) through a pair of knobs provided at ends thereof, so that an angle of the table top (1) relative to an axis of the cross beam tube (4) can be adjusted. Each of the pair of foldable supporting frames (2, 3) comprises a foldable side, a telescopic side and a bottom tube.

19 Claims, 18 Drawing Sheets

FOLDABLE TABLE FOR NOTEBOOK-COMPUTER

FIELD OF THE INVENTION

The present invention relates to a table, in particular to a foldable table for a notebook computer.

BACKGROUND THE INVENTION

Over one third of the human's life is spent in the bed. Lots of peoples used to be thinking, reading, studying and even working in bed. With the popularity of the notebook computer and its peripherals, many people enjoy using the notebook computer in bed. However, without appropriate articles, reading or using the notebook computer in bed will be very inconvenient and be prone to result in healthy damages, such as eyestrain, heterotropia, shoulder periarthritis and cervical diseases and so on. Further, for those who have to read and have meals in bed due to illness or oldness, inconvenience, discomfort and insanitary will also occur without an assisting article.

Under the circumferences, a few types of foldable table for a notebook computer are available in the market. Nevertheless, these foldable tables have deficiencies as follows.

1. These foldable tables are bulky, hulking, unwieldy and unsuitable for carry on, and have a limited extent for fold. Further, these foldable tables are unable to be applied on a normal desk as a more comfortable auxiliary article for a notebook computer. They are unable to satisfy the need to use a notebook computer both in bed and on a desk due to their limited extent for folding. Moreover, they do not combine the functions of such two different foldable tables as the table for a notebook computer and the heat dissipating supporting frame for the notebook computer which is popular and sold in a relatively large quantity in the market. The conventional foldable tables have to widen the table top of the table for the notebook computer so as to be able to provide a plane surface for using a mouse. However, the planar surface often appears to be inclined when used together with the table top on which the notebook computer is placed, which leads to the sliding-downward of the mouse in case of not being manipulated by the hand of a user and thus the inconvenience to the user. Moreover, the conventional foldable table with an additional mouse plate is generally bulky since a dilemma between the installation of a mouse plate and a compact size and light weight has not been solved for a long period of time. Meanwhile, the conventional foldable table is unable to be fully compacted and to be reduced in size. Additionally, it is difficult for the conventional foldable tables to move the plane surface for placing a mouse and to adjust the angle and position of the plane surface.

Secondly, with the conventional foldable tables, the height and angle of the table top is unable to be adjusted accurately, and the synchronizing positioning for the left and right table legs is inaccurate, causing the table legs not in a vertical position. Moreover, the use of the conventional foldable tables is not very easy and convenient, and the folding operations for the conventional foldable tables feel tiresome and unsmooth.

Thirdly, it is reported that fires caused by the overheating of the notebook computer in use happen frequently. As a result, means to facilitate the heat dissipation of the notebook computer has been attached much importance to. However, the conventional related foldable tables do not present a means to facilitate the heat dissipation of the notebook computer and an illuminator for reading, a speaker, a camera, a microphone, USB ports, an external power input socket and an additional power source able to help saving the battery power of the notebook computer, and thus are unable to make a good use of the extended functions of the notebook computer.

Finally, the factor that the wrist of the user is prone to be tired is not combined in the design of the conventional foldable tables. Furthermore, the conventional foldable tables do not present a room for containing articles often used with the notebook computer, such as USB flash memories, data cables, portable hard disks, emergency start-up disks, fountain pens. This practically is a severe deficiency which often causes mistakes or even accidents in work.

SUMMARY OF THE INVENTION

It is one object of the present invention to provide a foldable table for a notebook computer which has an optimized structure, is compact and portable, and occupies smaller space. It is another object of the present invention to provide a foldable table for a notebook computer which has more auxiliary functions.

To achieve the above-mentioned objects, the present invention provides a foldable table for a notebook computer, comprising a table top, a cross beam tube and a pair of foldable supporting frames provided at left and right ends of the cross beam tube; wherein the cross beam tube is movably and co-axially connected to a pair of lugs which are fixedly connected to the table top through a pair of knobs provided at ends thereof, so that an angle of the table top relative to an axis of the cross beam tube can be adjusted; each of the pair of foldable supporting frames comprises a foldable side, a telescopic side and a bottom tube, the foldable side comprises an upper foldable rod and a lower foldable rod which are interconnected in an articulated manner, the telescopic side comprises an inner sleeving and an outer sleeving in which the inner sleeving is slidably or fixedly accepted; the upper foldable rod is hinged to an upper end of the telescopic side at an upper end thereof, the lower foldable rod is hinged to the bottom tube at a lower end thereof; a top hook coupler is provided at the upper end portion of the telescopic side and hinged to angular couplers installed at its left and right ends, respectively, the top hook coupler and the angular couplers can be locked with each other, at least one of the angular couplers is movably connected to the cross beam tube; the upper foldable rod and the lower foldable rod are configured to font a rigid connection, the length of the inner sleeving or outer sleeving of the telescopic side is adjustable, and the bottom tube is used as a supporting side, so that the height of each of the pair of foldable supporting frames is adjustable.

In the foldable table for a notebook computer, each of the pair of foldable side further comprises a hinge block and a sliding sleeve, the hinge block is hinged between the upper foldable rod and lower foldable rod, the sliding sleeve movably covers interconnections of the upper foldable rod, the lower foldable rod and the hinge block so that the upper foldable rod and the lower foldable rod form a rigid connection.

In the foldable table for a notebook computer, an arcuate or circular axle is provided in each of the angular couplers and hinged to the top hook coupler, the angular couplers each has a C-shaped groove, the top hook coupler forms a tight-fit with the C-shaped groove, and the C-shaped groove locks the telescopic side by an elastic strain.

In the foldable table for a notebook computer, each of the pair of foldable supporting frames further comprises at least one intermediate foldable rod hinged between the hinge block and the lower foldable rod.

In the foldable table for a notebook computer, each of the pair of foldable supporting frames further comprises a spinning coupler, a fitting spindle and an end surface spring, the fitting spindle is fixedly connected to the top hook coupler, the telescopic side is fixedly connected to the spinning coupler at the upper end portion thereof, the fitting spindle is movably connected to the spinning coupler by the end surface spring, the upper foldable rod is hinged to the spinning coupler at the upper end portion thereof, the spinning coupler is co-axial with the top hook coupler, can elastically move in an axial direction with respect to the top hook connector and can be rotatably positioned in a radial direction with respect to the top hook connector.

The foldable table for a notebook computer further comprises a mouse plate assembly movably connected to a side edge of the table top, the mouse plate assembly is overlapped onto the table top in a folded state and is positioned at the side edge of the table top in use, and a surface for supporting a mouse is coplanar with the table top or is angled relative to the table top. The mouse plate assembly comprises a case, a link lever, a link lever locking handle, a link lever adjusting sliding block, a universal joint, a rocker and a rocker locking knob, the link lever is movably connected to a side of the case at one end thereof and is movably connected to the link lever adjusting block through the link lever locking handle at the other end thereof, the link lever adjusting sliding block is movably mounted at the side of the table top, and the rocker is movably connected to the side of the table top through the rocker locking knob at one end thereof and is movably connected to the side of the case through the universal joint.

The foldable table for a notebook computer further comprises a telescopic supporting frame mounted on a back surface of the table top, the telescopic supporting frame comprises a fixing base, a cage and a supporting frame, the fixing base is fixedly mounted on the back surface of the table top, the cage is hinged to the fixing base, a guiding rail or a guiding groove is provided on the supporting frame, a corresponding guiding rail or a corresponding guiding groove for cooperating with the supporting frame is provided on the cage, a locking member is provided on the cage, a catching notch is provided on the supporting frame, the locking member is clamped in the catching notch so as to lock the position of the cage relative to the supporting frame.

The foldable table for a notebook computer further comprises a telescopic supporting frame mounted on a back surface of the table top, the telescopic supporting frame comprises a fixing supporting base, a cage and a supporting frame, the fixing supporting base is fixedly provided on the back surface of the table top, the cage is hinged to the fixing supporting base, a pin or a guiding groove is provided on the supporting frame, a corresponding pin or a corresponding guiding groove for cooperating with the supporting frame is provided on the cage, a locking member is provided on the cage, a catching notch is provided on the supporting frame, the locking member is clamped in the catching notch so as to lock the position of the cage relative to the supporting frame. The telescopic supporting frame further comprises a side frame, an upper end of the side frame is hinged to an upper end of the cage, a lower end of the side frame abuts the supporting frame in use so that a triangle is formed by the side frame, the supporting frame and the cage.

The foldable table for a notebook computer further comprises an illumination assembly movably which is mounted at an edge of the table top and can be adjusted universally relative to the table top in an operation state. The foldable table further comprises a speaker assembly which is movably mounted at an edge of the table top, the speaker assembly can be adjusted universally relative to the table top in an operation state and overlapped onto the back surface of the table top in an inoperation state. The foldable table further comprises a battery case mounted on the back surface of the table top and USB ports provided at the edge of the table top. The foldable table further comprises a heat dissipating fan mounted on the back surface of the table top, and heat dissipating openings are provided at an interface between the table top and the heat dissipating fan.

As a result of the above-mentioned solutions, the foldable table of the present invention has the following advantages: effective design in the foldable structure, higher extent for folding, smaller size after being folded and portability in a notebook computer bag. The foldable supporting components of the foldable table of the present invention have two sides. One of the two sides is foldable, and the other of which is telescopic. Thus, both the height and angle of the table top are adjustable so that the foldable table can be used in a more flexible manner.

The space on front and back surfaces of the table top is utilized in the present invention. Since the table is foldable, a speaker, a camera, an illuminator and a mouse plate, etc. can be hid, which results in a neat, simple and compact appearance of the table. Moreover, the foldable table according to the present invention is provided with more additional functions which render it more convenient to use the foldable table. Variations of the foldable table can be achieved by adding, removing and combining components of the table and utilizing various folding manners, so that various functions are available.

In the foldable table of the present invention, the provision of heat dissipating openings on the table top as well as the installation of the a heat dissipating fan on the back surface of the table top can facilitate the heat dissipation of the notebook computer. Thus, the notebook computer will not overheat when used in bed, thereby avoiding potential accidents.

With a self-contained battery power which is not a part of the notebook computer, not only the heat dissipating fan but the speaker and illuminator can be powered. Furthermore, since the USB ports are provided in the foldable table of the present invention, multi-media players such as an MP3, an MP4 or the like can be used no matter whether the notebook computer is used or not. Hence, the foldable table of the present invention presents multiple functions.

With the telescopic supporting frame, when the foldable table is used on a desk, the angle of the bottom surface of the notebook computer relative to the desk and the height of the displayer may be adjusted and changed, so that it is more comfortable to use the notebook computer.

In the foldable table of the present invention, hand rests are provided to support hands of a user. The ergonomic effect is significantly improved, the tiredness of the hands is lessened and the overstrain of the user's hands is reduced. Therefore, the foldable table of the present invention is beneficial to the health of the user.

In the foldable table of the present invention, the illuminator is provided which can provide an illumination of various angles and small scope so that the need for the illumination in reading and use of the notebook computer is satisfied. Thus, the public illumination is not needed so that the illuminating effect is ensured without disturbing other people. Therefore, the foldable table of the present invention provides improved comfort and usefulness.

In the foldable table of the present invention, the mouse plate is configured to comprise a case which can be placed on the upper surface of the table top by turning and folding. The internal space of the case may contain computer operating system emergency start-up disks, data cables and so on, as well as other accessories such as USB flash memories, important disks, etc. Moreover, the external surface of the case may be used as a planar surface for a mouse to provide a convenient solution for a person who desires to use a mouse when using the notebook computer in bed without increasing the size and thickness of the foldable table of the present invention in a folded state.

DESCRIPTION OF THE EMBODIMENTS

Hereinafter, the present invention is illustrated in further detail based on the examples in connection with the accompanying drawings.

EXAMPLE 1

Figure 1:
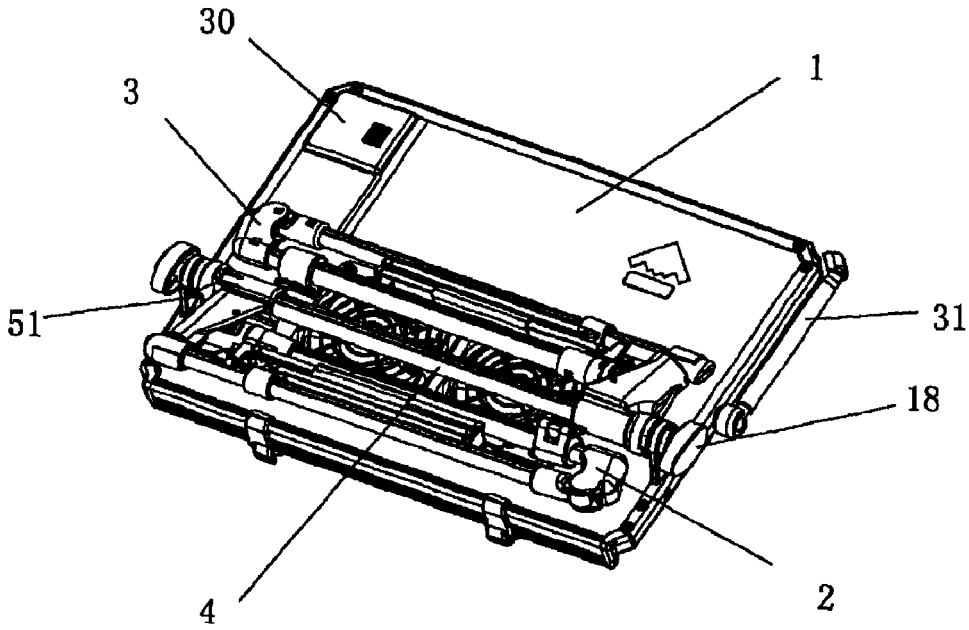
FIG. 1 is a perspective view showing a foldable table for a notebook computer according to Example 1 is completely folded.
Figure 2:
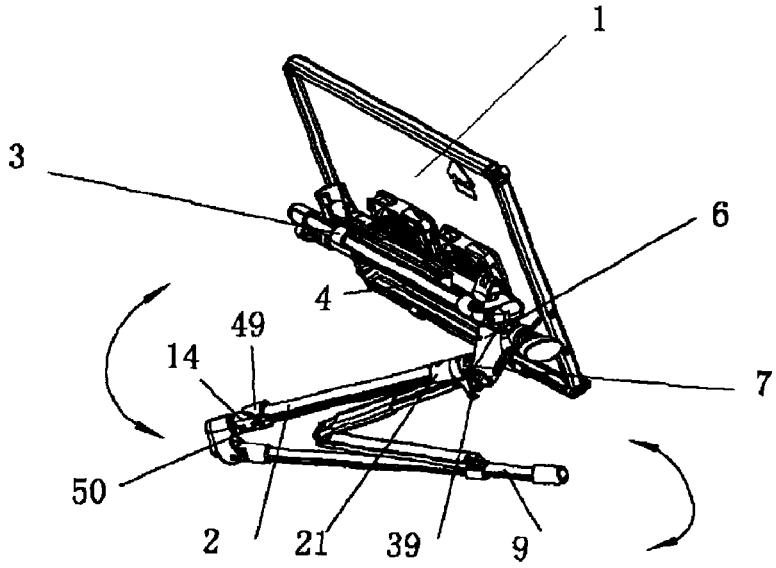
FIG. 2 is a perspective view showing a first step of expanding after the foldable table for the notebook computer according to Example 1 is completely folded is shown.

With reference to FIGS. 1 and 2, a foldable table for a notebook computer of the present example comprises a table top 1, a cross beam tube 4, a corner coupler 6 and foldable supporting frames 2, 3. The foldable supporting frames 2 and 3 are connected to the left and right ends of the cross beam tube 4, respectively, and have the identical configuration. One or more USB ports, a battery case 30 and an illuminator 31 are provided in the table top 1. Lugs 51 arranged on the left and right sides, respectively, are fixed to the table top 1. Both ends of the cross beam tube 4 are co-axially connected to the lugs 51. Knobs 18 are provided at both ends of the cross beam tube 4 and can lock the cross beam tube 4. As shown in FIGS. 2, 3, 7 and 11, angular couplers 6 are fitted to both ends of the cross beam tube 4, and a top hook connector 7 is provided on a top of the foldable supporting frame 2, so that the foldable supporting frame 2 can be rotated about a semi-circular hinge axle 8 arranged in the angular couplers 6 to expand outwardly or to fold inwardly in a converse manner.

As shown in FIGS. 2, 3, 4, 5, 6, 7, 8, and 9, taking the foldable supporting frame 2 for example, the foldable supporting frame of the Example 1 comprises a foldable side, a telescopic side and a bottom tube. The foldable side comprises an upper foldable rod 11 and a lower foldable rod 12 which are hinged with each other. The telescopic side comprises an inner sleeving 17 and an outer sleeving 16 in which the inner sleeving 17 can be slidably accepted. The top hook connector 7 is provided at the upper end of the telescopic side and hinged to the angular couplers 6 installed at the both ends of the cross beam tube 4, respectively. The top hook connector 7 and the angular couplers 6 can be locked with each other. One of the angular couplers 6 is movably connected to the cross beam tube 4 and the other is fixedly connected to the cross beam tube 4. The upper foldable rod 11 and the lower foldable rod 12 of the foldable supporting frame are configured to form a rigid connection, and the length of the inner sleeving 17 or outer sleeving 16 of the telescopic side is adjustable, so that the height of the foldable supporting frame is adjustable and the bottom tube being used as a supporting side. The foldable side also includes a hinge block 15 and a sliding sleeve 13. The hinge block 15 is hinged between the upper foldable rod 11 and the lower foldable rod 12. The sliding sleeve 13 slidably covers the interconnection of the upper foldable rod 11, lower foldable rod 12 and the hinge block 15 so that the upper foldable rod 11 and the lower foldable rod 12 form the rigid connection. The foldable supporting frame further comprises a spinning coupler 21, a fitting spindle 37 and an end surface spring 38. The fitting spindle 37 is fixedly connected to the top hook connector 7. The upper end of the telescopic side is fixedly connected to the spinning coupler 21. The fitting spindle 37 is movably connected to the spinning coupler 21 by the end surface spring 38. The upper end of the upper foldable rod 11 is hinged to the spinning coupler 21. The spinning coupler 21 is co-axial with the top hook connector 7, can elastically move in an axial direction with respect to the top hook connector 7 and can be rotatably positioned in a radial direction with respect to the top hook connector 7.

Figure 3:
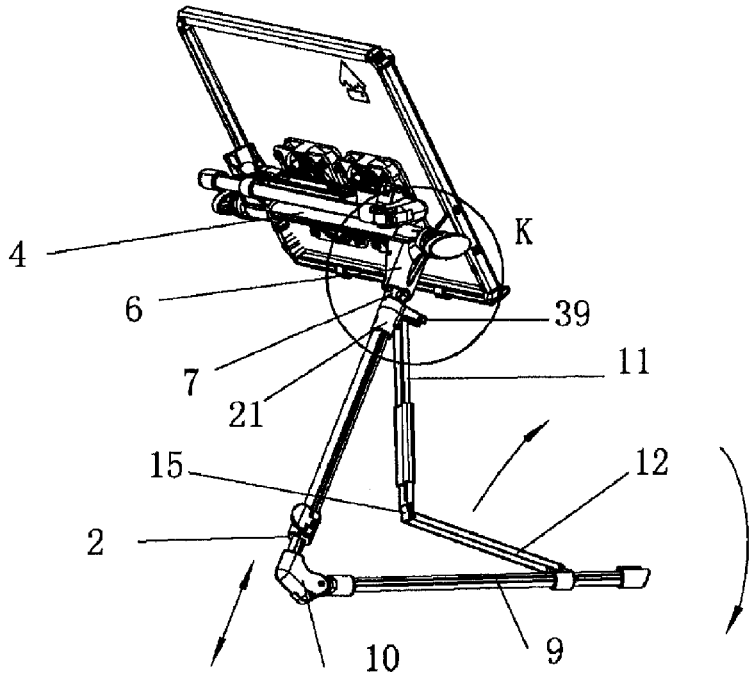
FIG. 3 is a perspective view showing a second step of expanding after the foldable table for the notebook computer according to Example 1 is completely folded.
Figure 12:
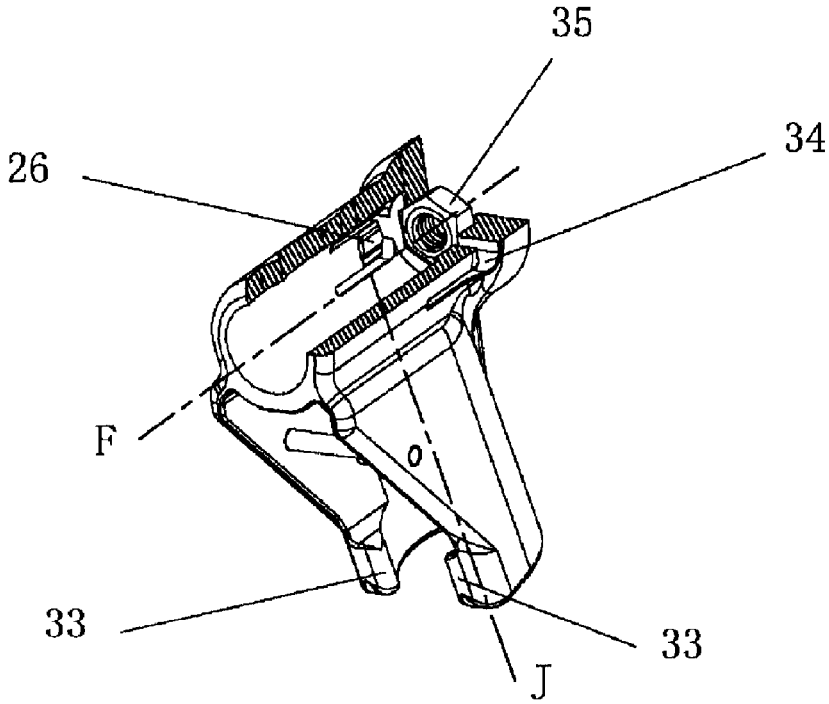
FIG. 12 is a partial section perspective view of the angular coupler 6 in Example 1.

With reference to FIGS. 3 and 12, the angular coupler 6 has a C-shaped groove and protrusions 33 at its opening. While the angular coupler 6 gets co-axial with the circular peripheral of the top hook coupler 7 of the foldable supporting frame 2, the protrusions 33 of the angular coupler 6 intends to automatically clamp the top hook connector 7. Thus, the bottom tube 9 of the foldable supporting frame 2 may be pulled upward and downward, and may be rotated around a hinge axle of the bottom tube coupler 10 until the upper foldable rod 11, the lower foldable rod 12 and the hinge block 15 are pulled into an approximately co-linear state.

Figure 4:
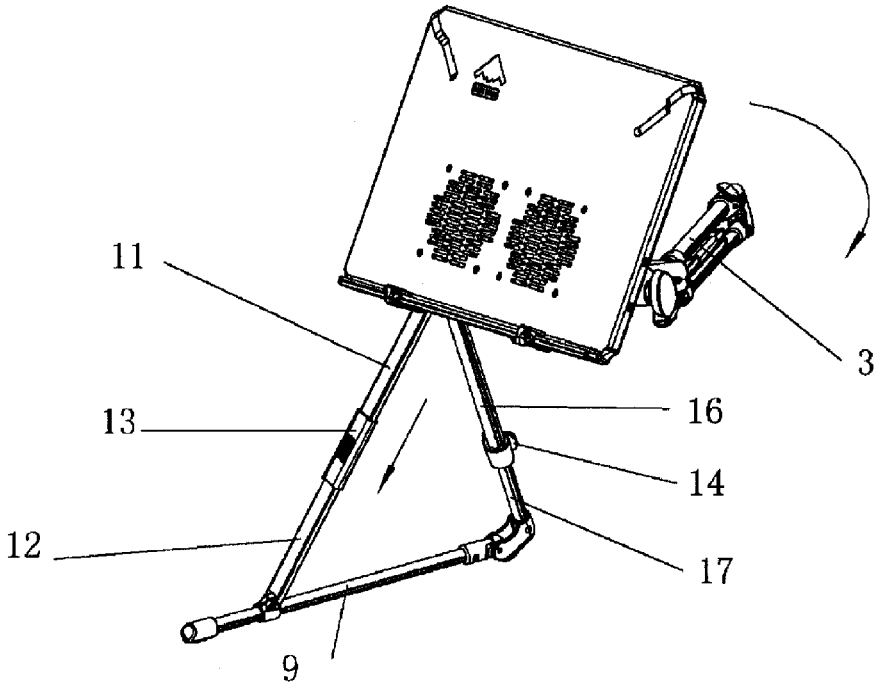
FIG. 4 is a perspective view showing a third step of expanding after the foldable table for the notebook computer according to Example 1 is completely folded.
Figure 5:
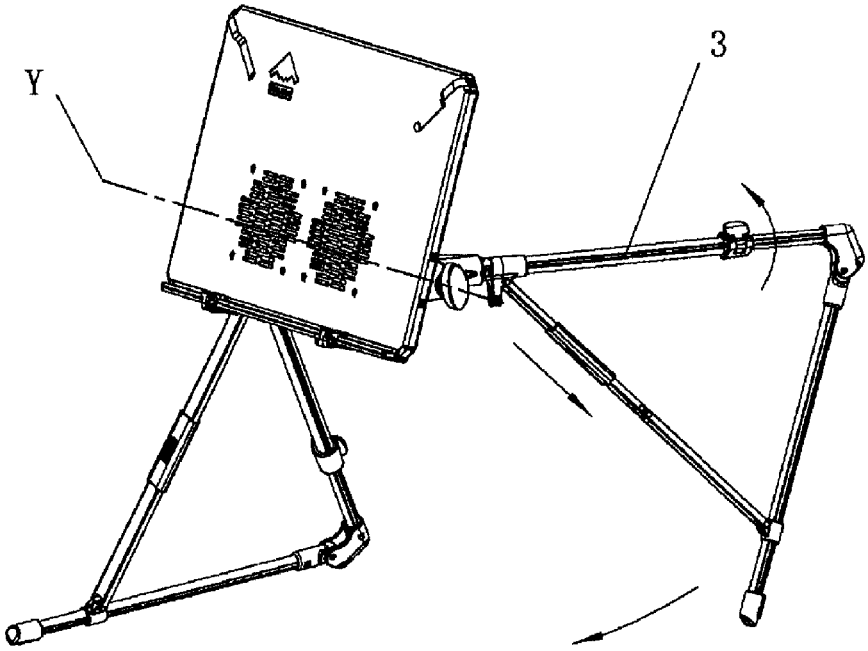
FIG. 5 is a perspective view showing a four step of expanding after the foldable table for the notebook computer according to Example 1 is completely folded.
Figure 6:
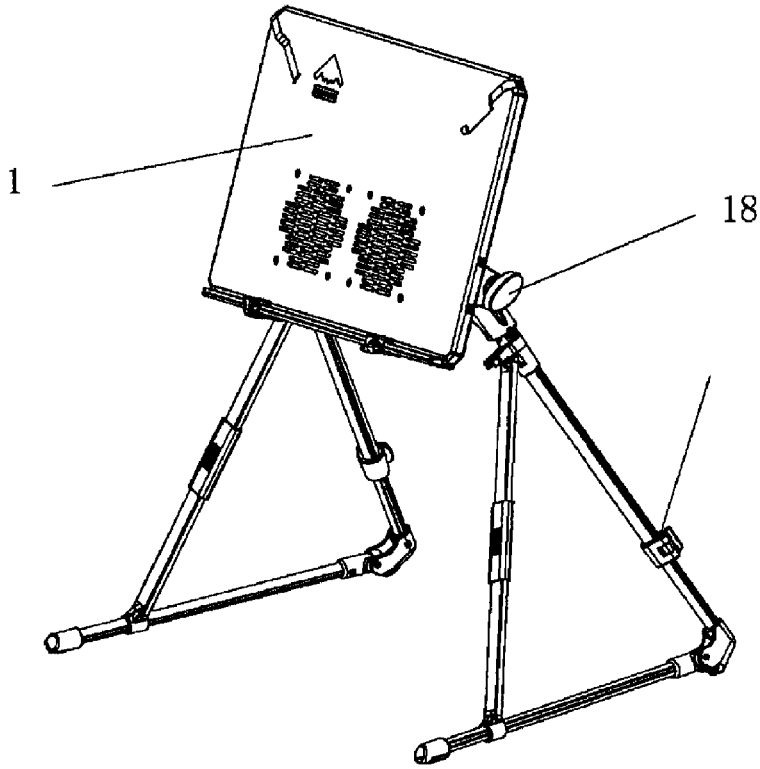
FIG. 6 is a perspective view showing the foldable table for the notebook computer according to Example 1 is completely expanded.
Figure 9:
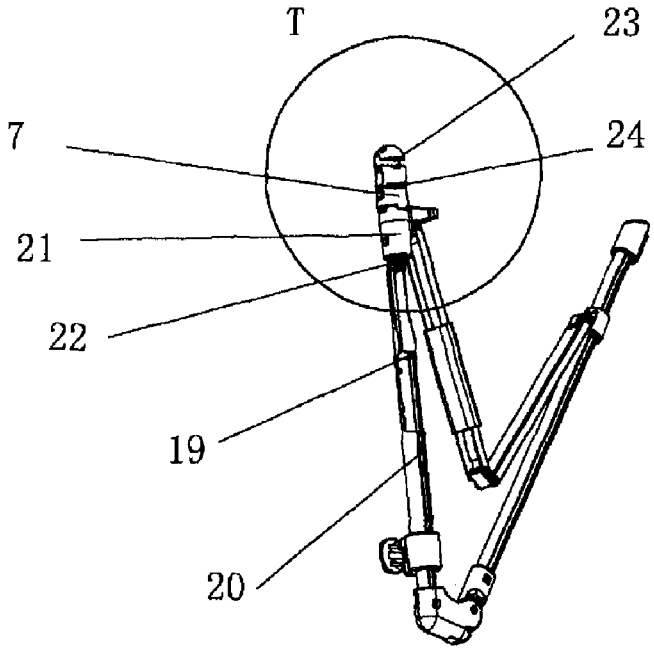
FIG. 9 is an enlarged perspective view showing a foldable supporting frame according to Example 1.
Figure 19:
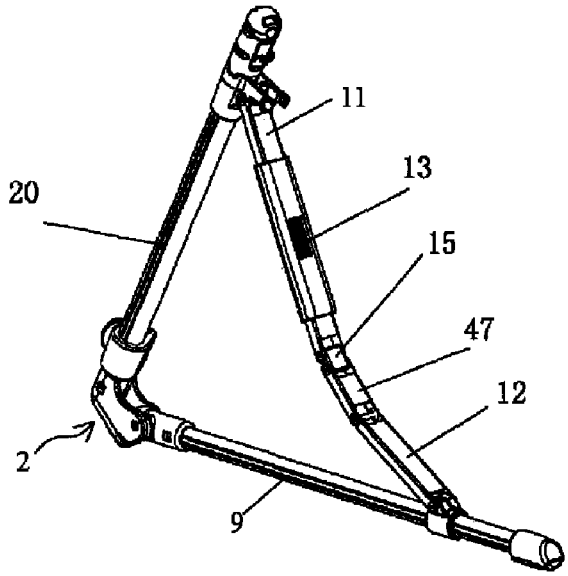
FIG. 19 is a perspective view showing a foldable supporting frame according to Example 4.
Figure 20:
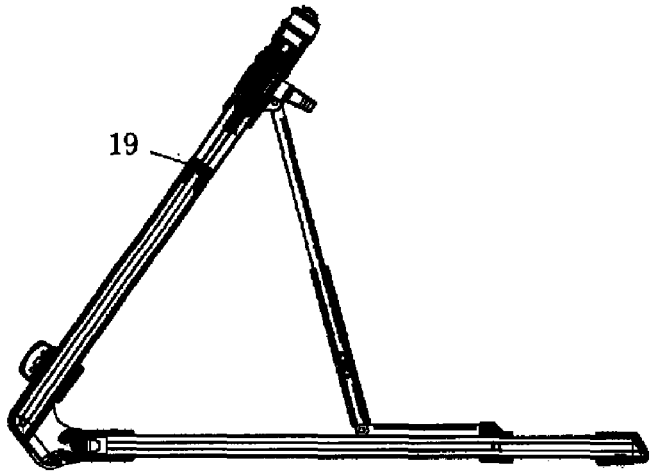
FIG. 20 is an enlarged perspective view showing the foldable supporting frame in FIG. 18.

Referring to FIGS. 4, 5 and 6, when the sliding sleeve 13 is pushed downward to a position where it also covers the top of the lower foldable rod 12, the foldable supporting frame 2 forms a triangle having the bottom tube 9 as a base side, the upper foldable rod 11 and the lower foldable rod 12 in the co-linear state as a rigid side, and the coaxial outer sleeving 16 and inner sleeving 17 as a telescopic side. As shown in FIGS. 9, 19 and 20, the inner sleeving 17 is pulled so that a latching steel ball 19 on a plug 52 of the inner sleeving comes into a latching hole 20 on the side wall of the outer sleeving 16, a locking button 14 is then pressed so that the outer sleeving 16 and the inner sleeving 17 are locked in respect of their sliding positions, and thus the length of the telescopic side is determined. In this manner, the foldable supporting frame 2 may form a load-bearable and stable triangle, the adjustable length of which may have an effect on a working height of the table top 1.

Referring to FIG. 5, two foldable supporting frames may form stable triangles which are identical and symmetrical in the similar manner. In the meantime, symmetrical and synchronization positions are formed by rotating the foldable supporting frames around the axis of the cross beam tube 4.

Referring to FIG. 6, when the knobs 18 at the both ends of the cross beam tube are tightened, the table top 1 is fixed and may support a notebook computer and other articles such as books.

Figure 7:
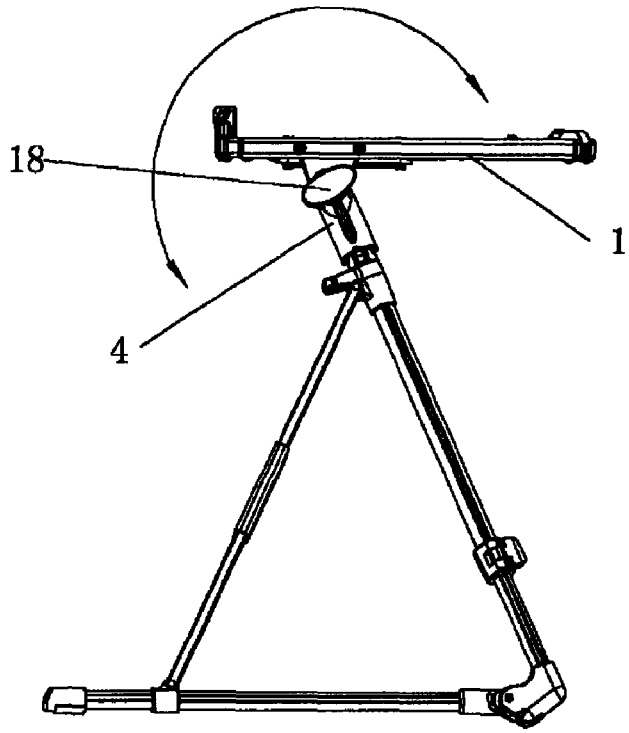
FIG. 7 is a side view showing the foldable table for the notebook computer according to Example 1 is completely expanded.

Referring to FIG. 7, when the knobs 18 are loosened, the table top 1 may be rotated about the axis of the cross beam tube 4 to adjust the angle so as to be adapted to different applications. In FIG. 7, the table top 1 is shown in a horizontal position where a notebook computer can be placed thereon and the dishware can be placed thereon as well so as to satisfy the need for having a meal in bed.

Figure 8:
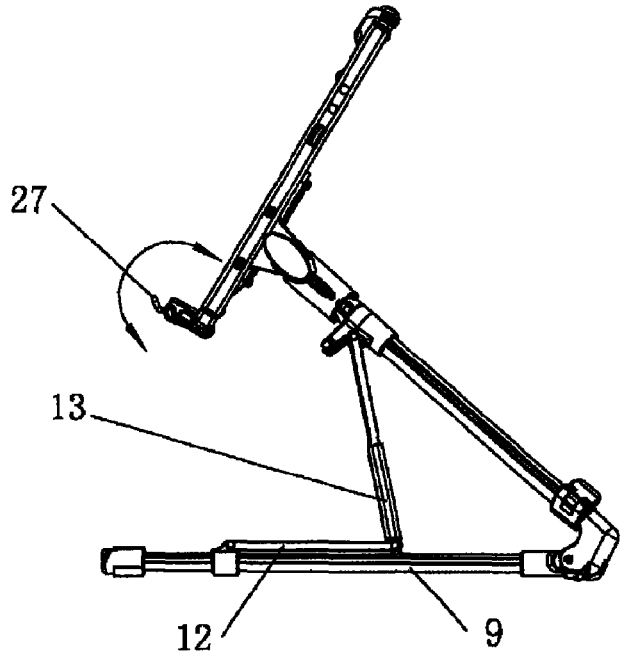
FIG. 8 is a side view showing the foldable table for the notebook computer according to Example 1 is partly expanded.

Referring to FIG. 8, when the sliding blocks 13 on the left and right foldable supporting frames 2 and 3 are moved upward such that the lower foldable rod 12 is approximately in parallel to the bottom tube 9, the foldable supporting frames 2 and 3 may form a stable triangle with a smaller size. Thus, the working height of the table top 1 can be further lowered so that the user feels as comfortable as the notebook computer is placed on a conventional desk.

Figure 11:
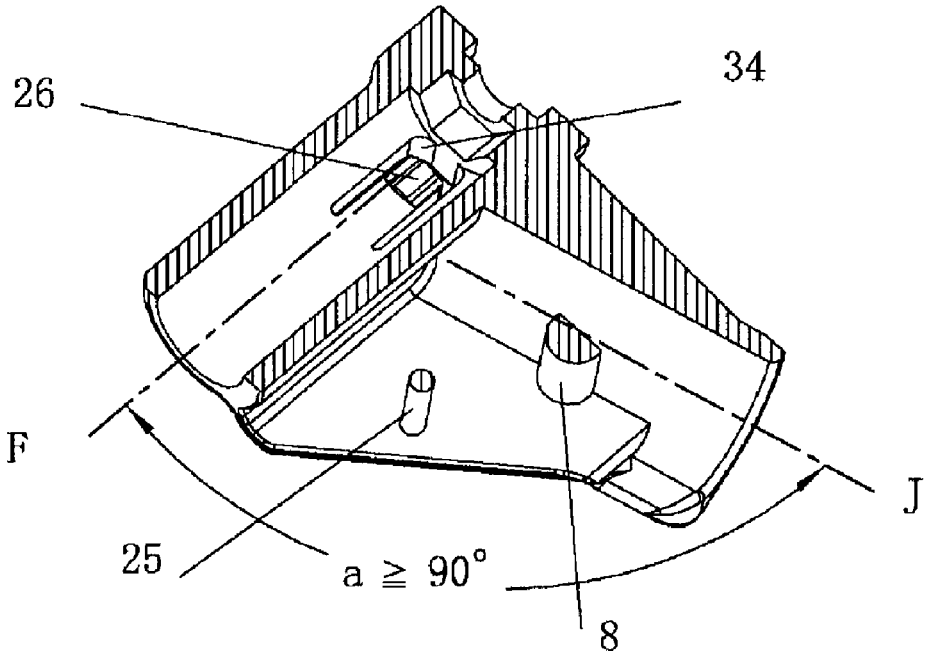
FIG. 11 is a section perspective view of an angular coupler 6 in Example 1.

Referring to FIGS. 9 and 11, a circular hole 23 is provided on the top hook connector 7. During assembly, the semi-circular hinge axle 8 in the angular coupler 6 engages and hinges into the circular hole 23. A circular hole 24 is able to engage with a column 25 in the angular coupler 6 on the cross beam tube 4 in order to fix the foldable supporting frame in a folded state.

Figure 10:
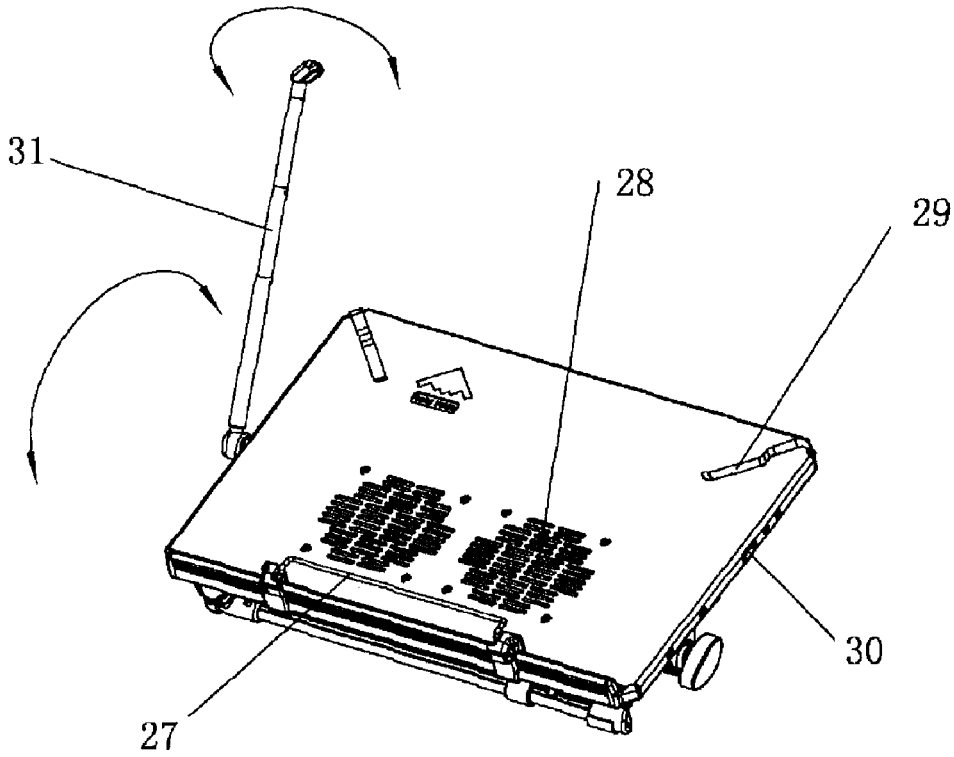
FIG. 10 is a perspective view showing the foldable table for the notebook computer according to Example 1 is folded.

Referring to FIGS. 1 and 10, a poled illuminator 31 is mounted on the left of the table top 1. Also, clamping springs for book pages 27 and 29 are provided on the table top 1 for clamping pages of a book or papers during reading or writing. Heat dissipating openings are provided in the middle of the table top 1 and a dissipating heat fan is mounted in the corresponding position on the back of the table top 1. One or more USB ports and other sockets are provided on the side of the table top 1, and the battery case 30 is mounted on the back of the table top 1.

Referring to FIG. 11 which is a section perspective view of the angular coupler 6, projections 26 on the angular coupler 6 cooperate with two grooves on the 8-shaped section of the cross beam tube. The projections 26 have such shape and elasticity that the synchronous positions of the foldable supporting frames 2 and 3 can be fixed. A U-shaped slit 34 is provided on the exterior of the projection 26 in order to make the projection 6 flexible and thus to automatically lock during the rotation of the foldable supporting frames 2 and 3. The column 25 within the cavity of the projection 26 serves to lock the foldable supporting frames 2 and 3 after being folded. The semi-circular axle 8 on the cross beam tube 4 may hinge in the hole of the top hook connector 7 on the foldable supporting frames 2 and 3. The semi-circular axle 8 has a semi-circular section so that the top hook connector 7 can be clamped therein, improving the assembly efficiency and reducing the cost. The angle between the two hole center lines F and J is greater than or equal to 90 degrees.

Referring to FIG. 12 which is a partial section perspective view of the angular coupler 6 on the cross beam tube 4, protrusions 33 of the edge of a lower hole of the angular coupler 6 serves to produce an effect of automatically clamping and centering when the top hook connector 7 is rotated around the hinge axle 8 in the angular coupler 6 to become approximately co-axial with the lower hole, and keeping the positions where the foldable supporting frames 2 and 3 open outward stable and symmetrical. The shape and function of the projection 26 and U-shaped slit 34 may be judged in the FIG. 12. A locking nut 35 serves to make the cross beam tube 4 cooperate with the knob 18 on the table top 1.

Figure 13:
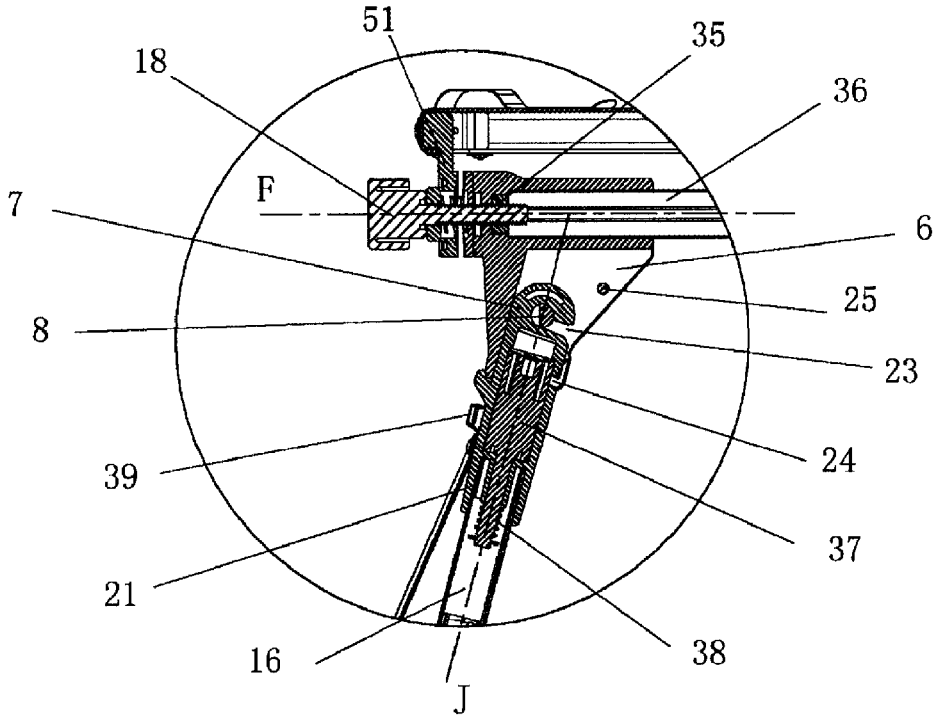
FIG. 13 is an enlarged view showing the fitting relationship among various components in Example 1.

Referring to FIG. 13, the top hook connector 7, the outer sleeving 16, and the spinning coupler 21 on the foldable supporting frames 2 and 3 are connected by the fitting spindle 37. The end surface spring 38 is also shown in FIG. 13. With the end surface spring 38, the top hook connector 7 and the spinning coupler 21 may move elastically and can be rotated. It can be understood from FIG. 13 that the table top 1 and the cross beam tube 4 may be fixed when the knob 18 is tightened, and the table top 1 may be rotated about the axis of the cross beam tube 4 when the knob 18 is loosened. When the foldable supporting frame 2 or 3 is rotated counter-clockwise, the top hook coupler 7 intends to rotate around the semi-circular axle 8 of the angular coupler 6, and the column 25 can be engaged in and get locked in the hole 24 on the top hook coupler 7. The spinning coupler 21 is co-axial with the top hook coupler 7 and may elastically move in an axial direction and spin.

Figure 14:
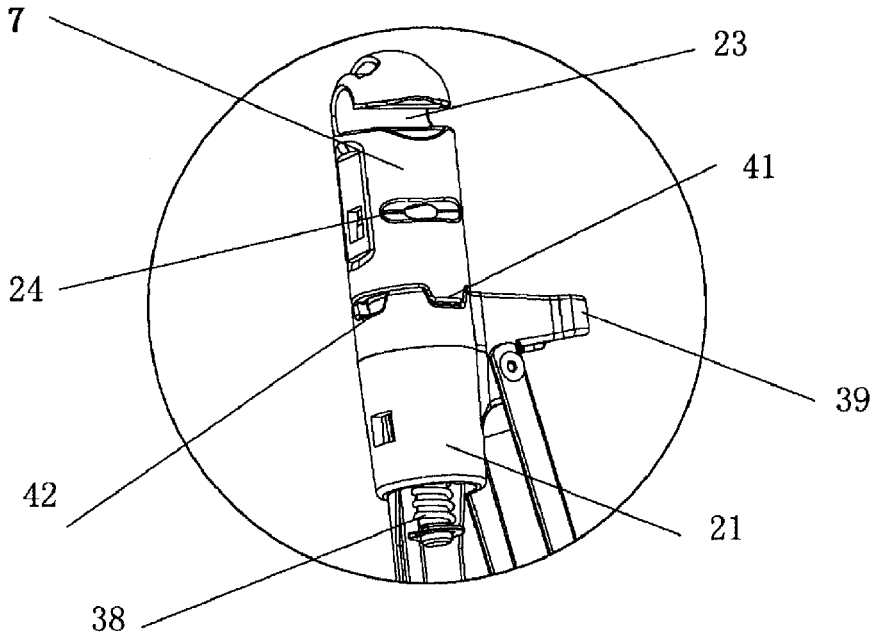
FIG. 14 is an enlarged view of the portion T in FIG. 9.

Referring to FIG. 14 which is an enlarged view of the portion T in FIG. 9, a jut 41 is provided on the lower end face of the top hook coupler 7. With the cooperation of the jut 41 with two indentations 42 on the top face of the spinning coupler 21 and with the help of the spring 38, the position of the spinning coupler after spinning can be restricted.

Figure 15:
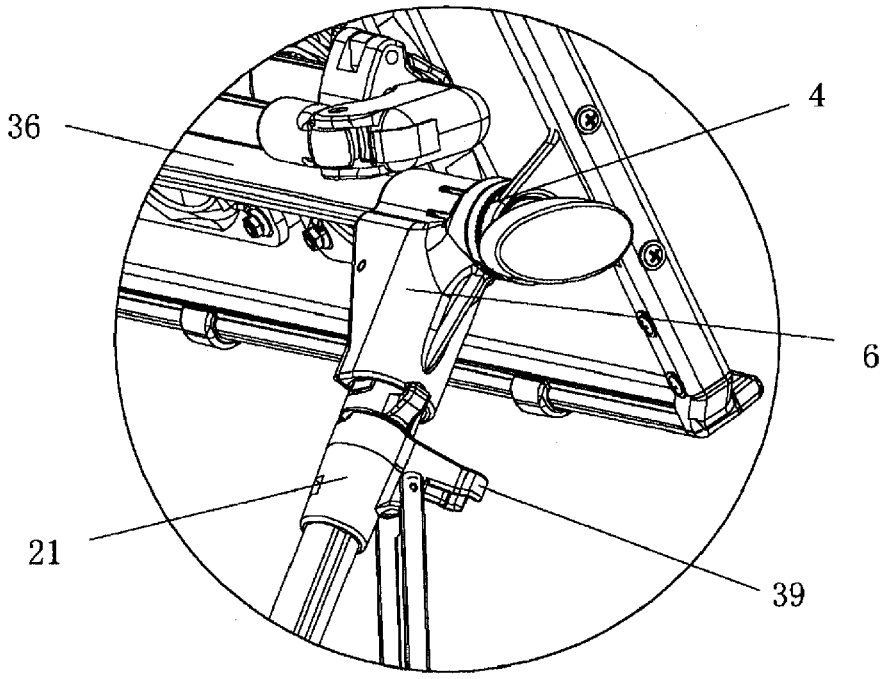
FIG. 15 is an enlarged view of the portion K in FIG. 3.

Referring to FIG. 15 which is an enlarged view of the portion K in FIG. 3, it is shown the cross beam tube component 4, the spinning coupler 21, a cross beam tube 36, the angular coupler 6 and a clamper 39 of the spinning coupler 21. When the foldable supporting frame is folded, the bottom tube 9 is clamped in the clamper 39 so that the foldable supporting frame can be fixed.

EXAMPLE 2

Figure 16:
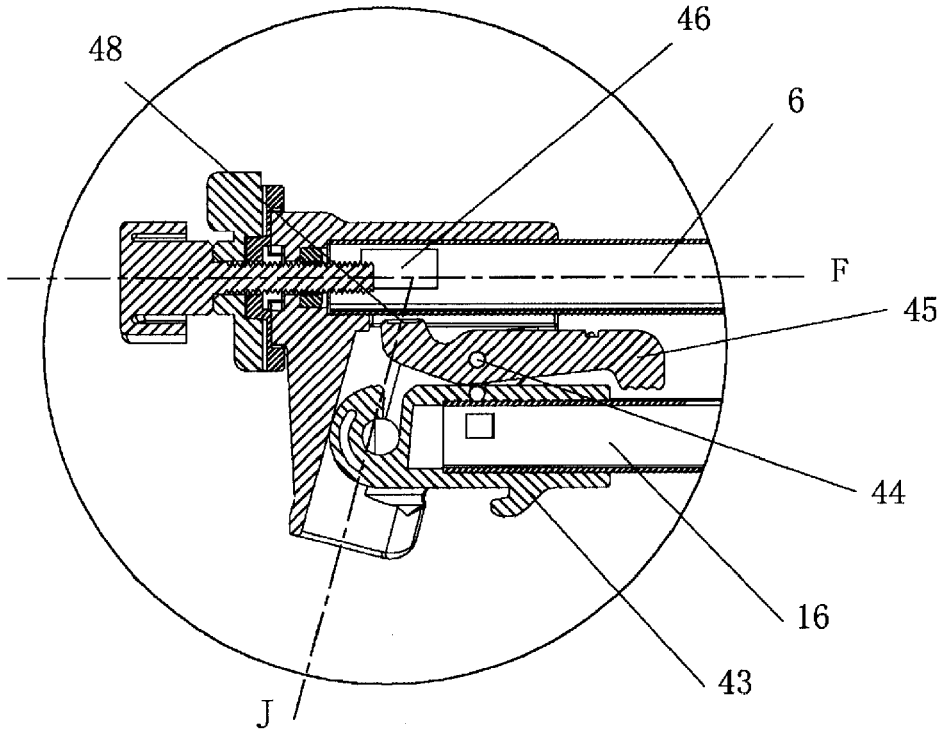
FIG. 16 is a section view showing partially the fitting relationship of Example 2.

Referring to FIG. 16, it shows another configurations of the foldable supporting frames 2 and 3 in which the top hook coupler 7 in the above-mentioned foldable supporting frames 2 and 3 is replaced by a top hook coupler 43. The top hook coupler 43 is fixedly connected to the outer sleeving 16 directly and the connections among the spinning coupler 21, fitting spindle and end surface spring 38 are removed. As shown in FIG. 16, a column 44 provided in an angular coupler 6 engages co-axially into a hole on the section of a synchronizing handle 45. A co-axial torsional spring 47 is provided on the column 44 and provides a torque such that a left tip 48 presses the exterior peripheral of a cross beam tube 4. When an opening 46 on the cross beam tube 4 rotates to a position where the opening 46 matches the left tip 48 of the synchronization handle 45, the left tip 48 can be automatically clamped in the opening 46 of the cross beam tube 4 and locks the cross beam tube 4 in order to symmetrically synchronize and restrain the foldable supporting frames 2 and 3. The right end of the synchronization handle 45 is pressed down before folding so that the left tip 48 disengages from the opening 46 of the cross beam tube 4. Thus, the foldable supporting frames 2 and 3 may be rotated about the axis of the cross beam tube so as to satisfy the requirements for the position when folded.

EXAMPLE 3

Figure 17:
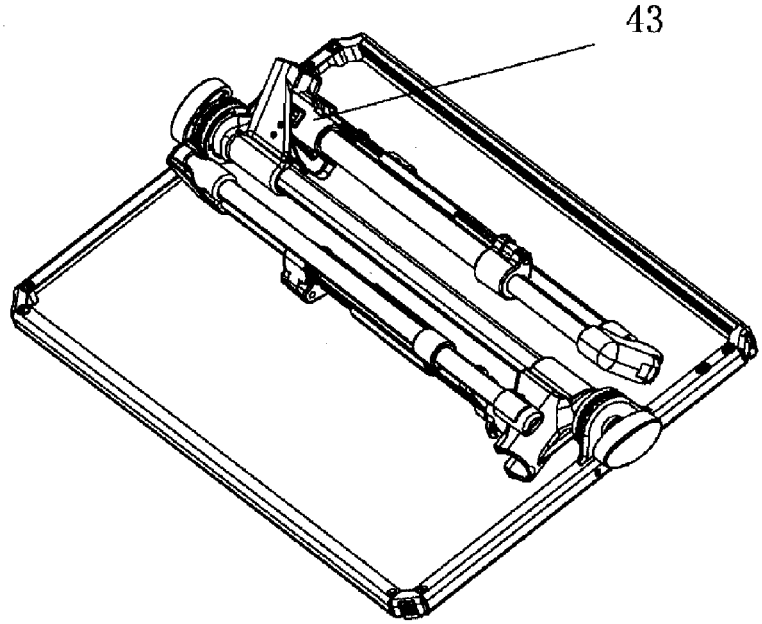
FIG. 17 is a perspective view showing a foldable table for a notebook computer according to Example 3.

Referring to FIG. 17, the present example simplifies the above-mentioned two examples in structure. In the present example, heat dissipating openings, a fan, a USB port or USB ports 28, a battery case 31 and a poled illuminator 31 are not included. Foldable supporting frames 2 and 3 cooperate with angular couplers 6 in a direct use of a top hook coupler. Thus, the folding manner is changed that the foldable supporting frames 2 and 3 can be folded with one folding step being omitted. Therefore, the folding process is simpler but the height of the foldable supporting frames after being folded increases lightly.

EXAMPLE 4

Figure 18:
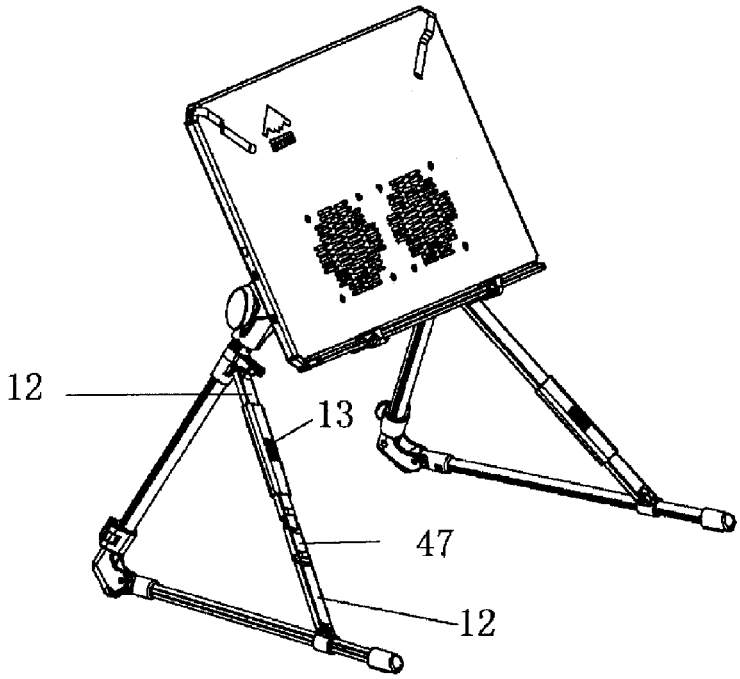
FIG. 18 is a perspective view of a folding manner which is used by a foldable table for a notebook computer according to Example 4.

FIGS. 18 and 19 are perspectives views showing the folding manner which is used in the present example. In the present example, an intermediate foldable rod 47 is added in each of foldable supporting frames 2 and 3. After a sliding sleeve 13 is pulled downward to cover the hinge block 15, the intermediate foldable rod 47 and the lower foldable rod 12, the foldable side formed thereby may become a rigid side. Where the sliding block 13 is pulled to cover the intermediate foldable rod 47, the number of the foldable rod 47 can increase so that the table top 1 has variety of height after the foldable supporting frames 2 and 3 are expanded. It can be seen from FIGS. 18 and 19 that a latching hole 20 is provided on the side of the outer sleeving 16.

Referring to FIG. 20, the sliding sleeve 13 is pulled downward to cover the hinge block 15 and intermediate foldable rod 47 only so that the lower foldable rod 12 becomes parallel to a bottom tube 9 and thus the height of the table top is changed. The position of a latching steel ball 19 may be seen more clearly in FIG. 20.

Figure 21:
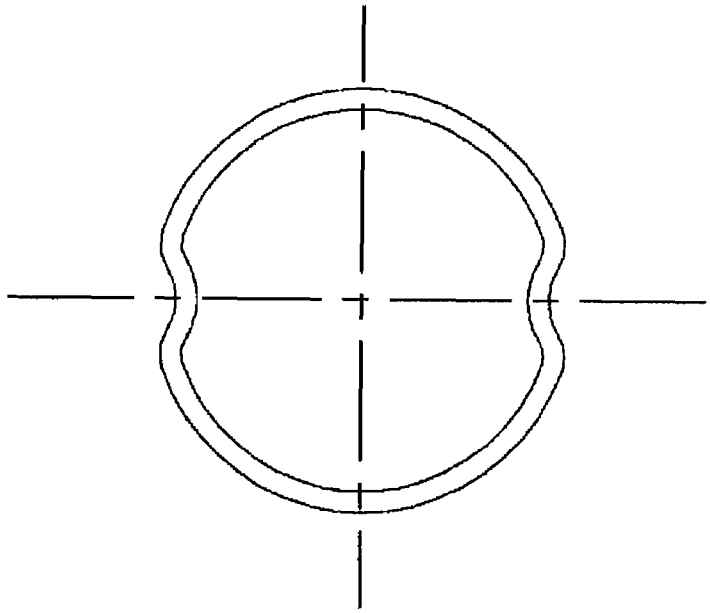
FIG. 21 is a section view of a cross beam tube 4.

Referring to FIG. 21, which is a section view of a cross beam tube 4, it can be seen that the section of the cross beam tube 4 has an approximately 8-shape.

EXAMPLE 5

Figure 22:
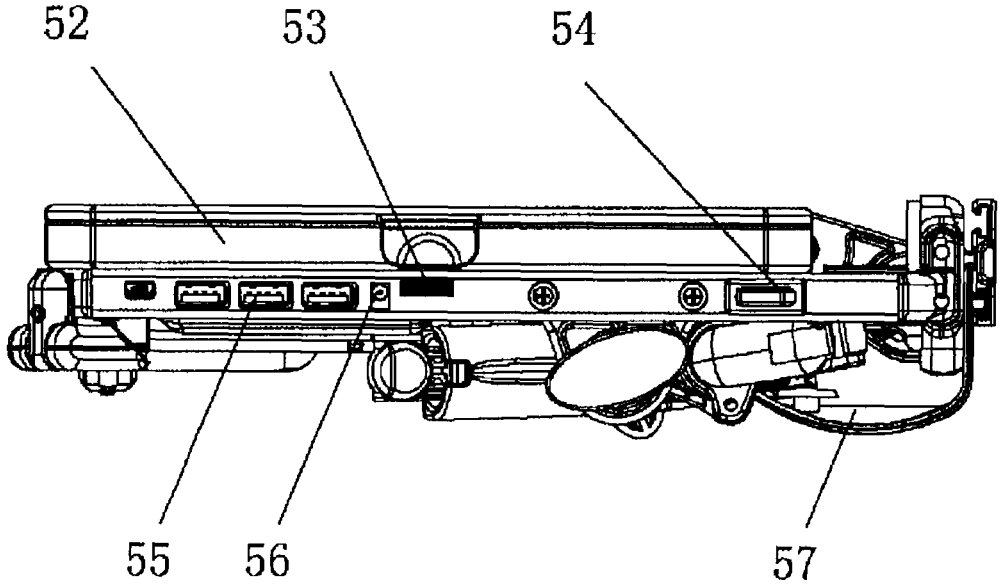
FIG. 22 is a side view showing a foldable table for a notebook computer according to Example 5.
Figure 23:
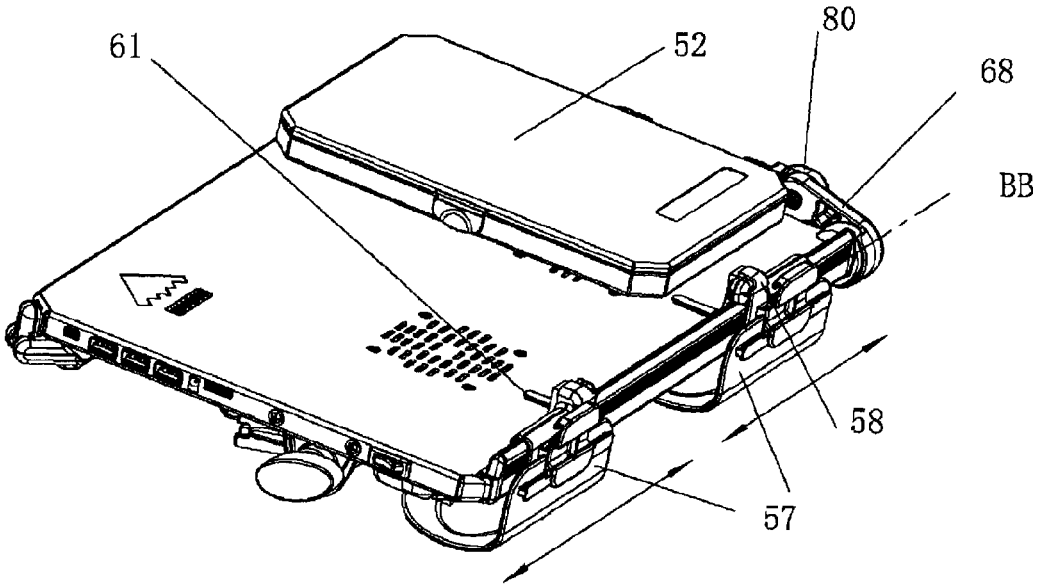
FIGS. 23 and 24 are perspective views showing the foldable table for the notebook computer according to Example 5.
Figure 24:
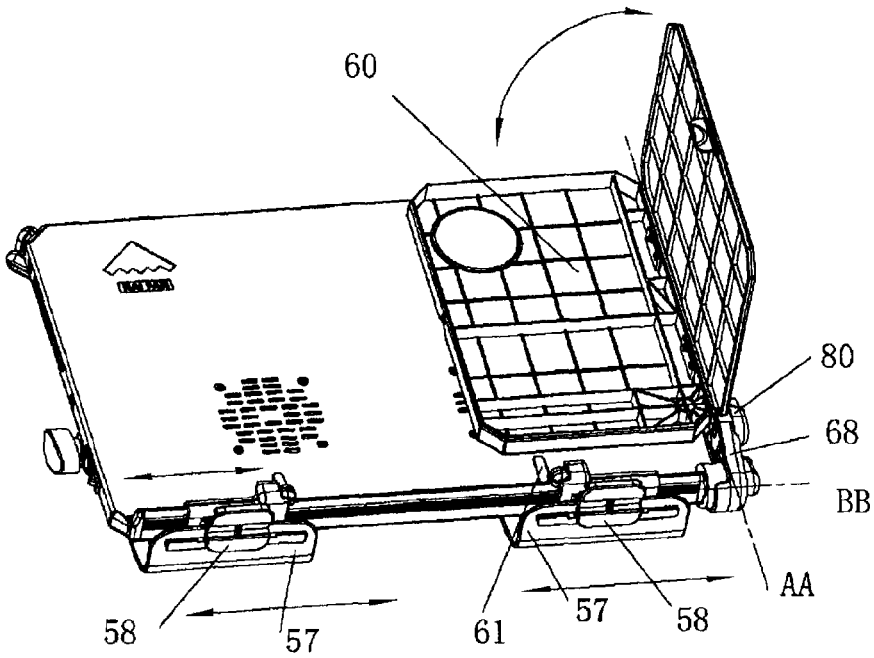

FIG. 22 is a side view of the present example, and FIG. 23 is a perspective view of the present example.

As shown in FIGS. 22-31, in the present example, a mouse plate assembly 52, a fan speed regulating knob 53, a fan switch 54, hand-rests 57 are fixed to the table top 1, and USB ports 55 and socket 56 for connecting an external power are provided on the side of the table top. The mouse plate assembly 52 comprises a case 60, a link lever 82, a link lever locking handle 89, a link lever adjusting sliding block 86, a universal joint 80, a rocker 68, a rocker seat 79 and a rocker locking knob 81, etc.

Figure 40:
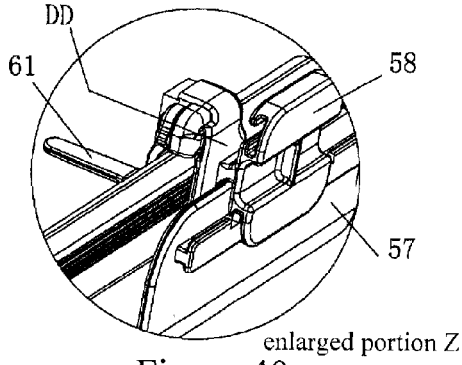
FIG. 40 is an enlarged view of the portion Z in FIG. 26.
Figure 41:
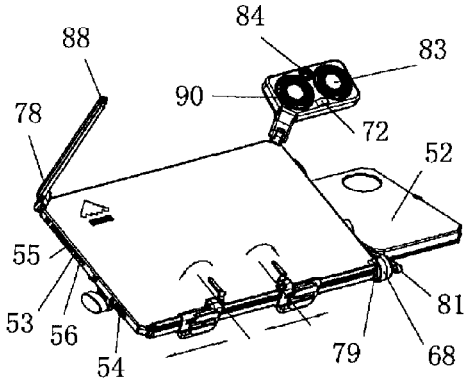
FIG. 41 is a perspective view showing a combination of a speaker, an illuminator and the mouse plate assembly.

Referring to FIGS. 23, 24, 25, 26, 27, 28, 29 and 30 and in combination with FIG. 40, the sliding seats 58 may slide left and right in the direction illustrated by linear arrows along the lower edge of the table top. Each of the sliding seats 58 is provided with a leaf spring for clamping book pages 61, which is arranged to be symmetrical to each other. Each of the hand-rests 57 engages into a T-shaped groove of the respective sliding seat 58, and also may slide left and right in the direction illustrated by the linear arrows and be removed from the respective sliding seat 58. The rocker 68 is movably connected at the left end below the table top and may swing around the connection axle with respect to the radial direction. The universal joint 80 connects the rocker 68 to the mouse pate assembly 52. The case 60 of the mouse plate assembly 52 has a lid which may be opened and closed in the direction illustrated by arc arrows and is provided with a lock fastener on its edge. The case 60 of the mouse plate assembly 52 may be suitable to contain emergency accessories and sundry items, such as portable hard disks, USB flash memories, data cables, power cables, emergency start-up disks, fountain pens, cleansers, perfumes and the like.

Figure 25:
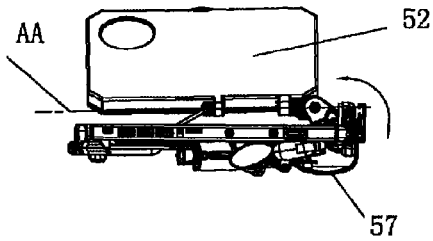
FIGS. 25, 26, 27, 28, 29, 30 and 31 are perspective views showing a opening procedure of a lid of a mouse plate assembly.

As shown in FIG. 25, the case 60 of the mouse plate assembly 52 has been turned over from the table top. FIG. 25 shows the hand-rest 57 which is mounted in a lower position and the arc arrow illustrating the direction in which the rocker is rotated. The side 87 of the case 60 of the mouse plate assembly 52, when being parallel to the right side of the universal joint 80, will be restrained by the universal joint 80. Thus, the back surface of the case 60 of the mouse plate assembly 52 can be kept transversely parallel to the table top and bear the dynamic load during the mouse is used.

Figure 26:
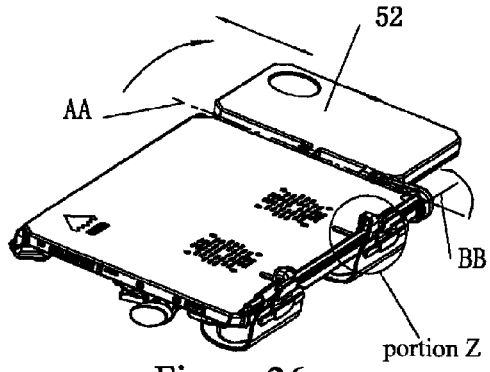

As shown in FIG. 26, the case 60 of the mouse plate assembly 52 is approximately in parallel to the table top 1 and can continue to swing in the direction illustrated by the arc arrows and around an axis "BB" and to move forward and backward. Portion Z is a detail of the sliding seat 58, which will be shown in an enlarged view later.

Figure 27:
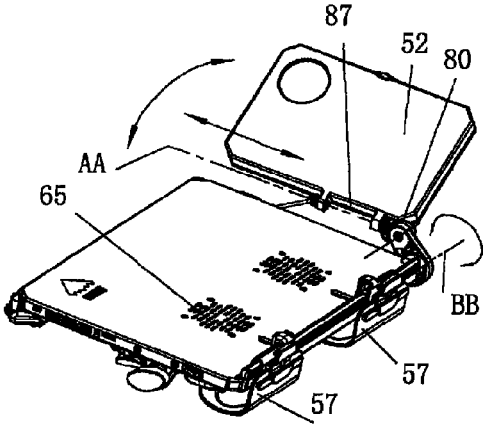
Figure 55:
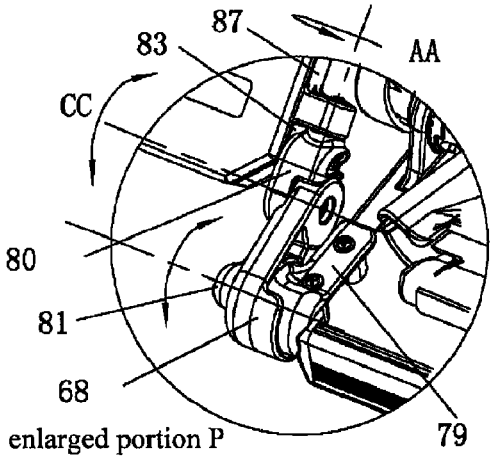
FIG. 55 is a partial enlarged view of the portion P in FIG. 37.

As shown in FIGS. 27 and 55, the case 60 of the mouse plate assembly 52 is turned over in the direction illustrated by the arc arrows along an axis "AA", the rocker 68 swings in the direction illustrated by the arc arrows along the axis "BB", and the case 60 of the mouse plate assembly 52 moves forward and backward in the direction illustrated by a linear arrow and its angle is varying. When the left side 87 is parallel to and contacts a right side of the universal joint 80, the case 60 of the mouse plate assembly 52 is restrained and thus is unable to continue to be turned over downward.

Figure 28:
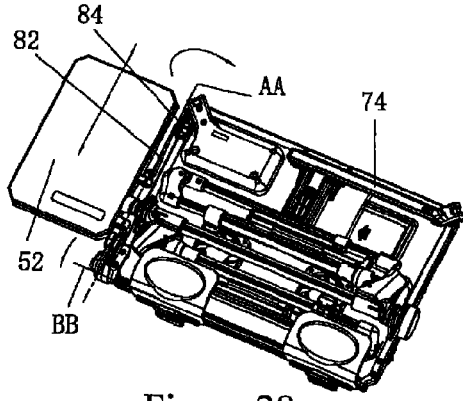

As shown in FIG. 28, an illumination assembly 74 comprises a LED light and a microphone integrated at the tip of the LED light. The rocker 68 may be rotated around the axis "BB" and brings the mouse plate assembly 52 to move forward, backward, upward or downward. Also, the rocker 68 is constrained by the link lever 82 and the link lever locking handle 89.

Figure 29:
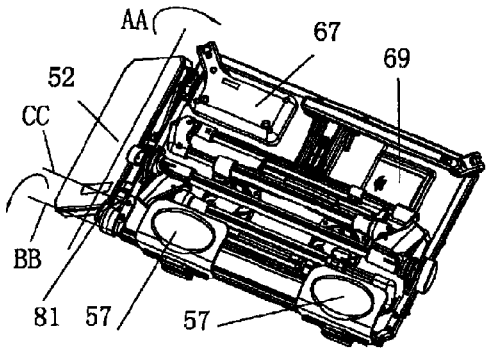

As shown in FIG. 29, a speaker assembly 67, a battery case 69 and a Hub circuit assembly are provided on the back surface of the table top, etc.

Figure 30:
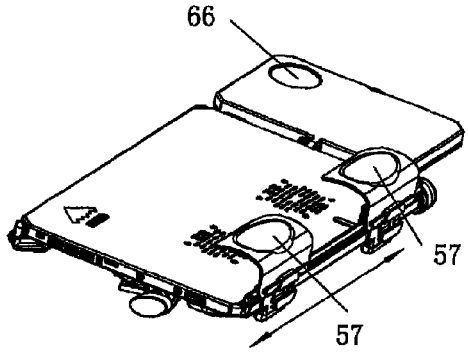

As shown in FIG. 30, the case 60 of the mouse plate assembly 52 has a cup holder opening 66 on its functional surface for a mouse, and the hand rests 57 are changed to face upward so as to bear the wrists of a user and thus can reduce the tiredness of the user's arms.

Figure 31:
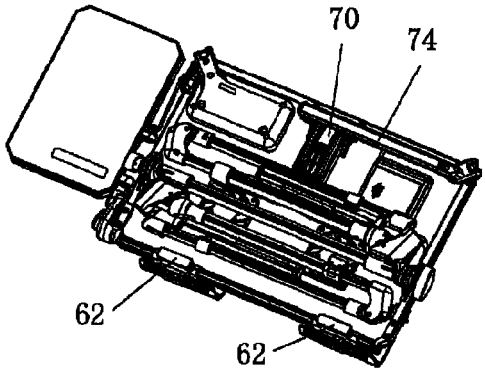

As shown in FIG. 31, a telescopic supporting frame 70, which is folded on the back surface of the table top 1 when it is not in use, is provided in the present example, and an anti-slip pad 62 is provided on the bottom of the sliding seats 58. The telescopic supporting frame 70 comprises a cage, a side frame and a supporting frame.

Figure 33:
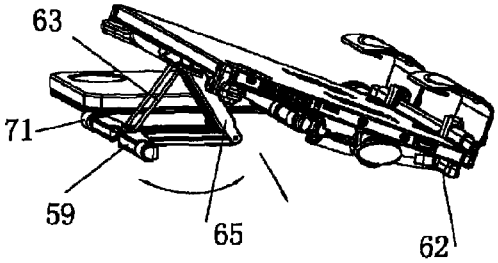
Figure 43:
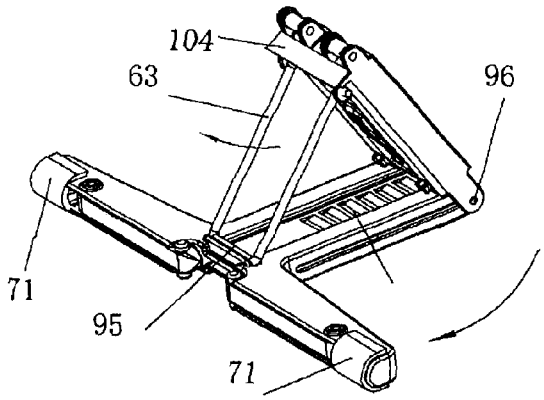
FIGS. 43, 44, 45 and 46 are perspective views showing the telescopic supporting frame is in a working state.
Figure 44:
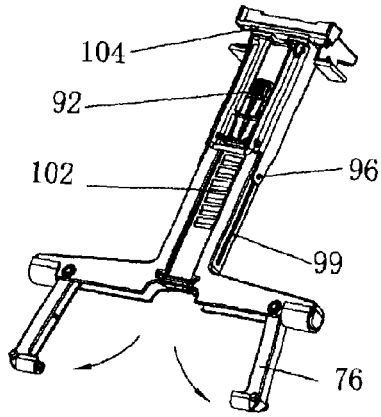

As shown in FIGS. 33, 40 and 43, the telescopic supporting frame 70 has been deployed from its folded state. The side frame 63 consists of a steel wire supporting frame, and the supporting frame consists of a T-shaped frame 59. The T-shaped frame 59 may be pulled out of the cage 65 in the direction illustrated by a linear arrow and then be rotated to be supported by the side frame 63, so that the telescopic supporting frame 70 turns into a triangle configuration. Further, anti-slip pads 71 and 73 are provided on both ends and the top of the T-shaped frame 59. The anti-slip pads 71 and 73 together with the anti-slip pads 62 of the sliding seats 58 constitute a 6-point-support anti-slip plane which may swing so as to self-adapt to various applications, such as the desktop.

Figure 37:
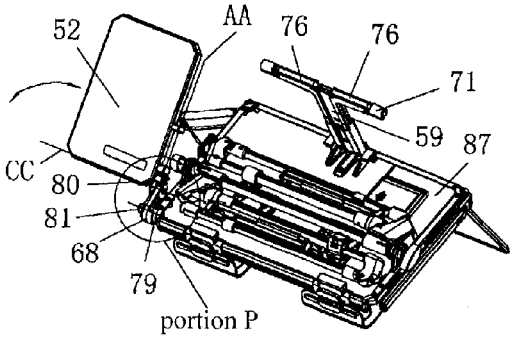
Figure 38:
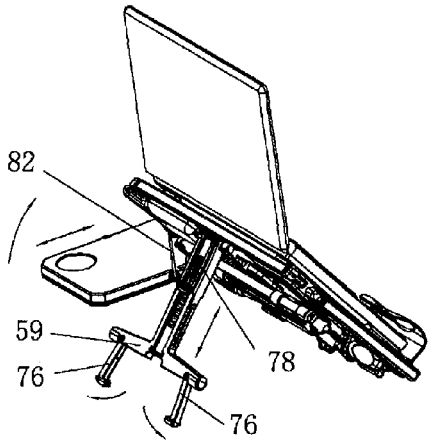
FIGS. 38 and 39 are perspective views showing the T-shaped supporting frame is in a supporting state of the highest position.

As shown in FIG. 37, the anti-slip pad 73 on the bottom of the upper end of the T-shaped frame 59 together with the anti-slip pad 71 constitute a triangle plane which moves in the direction illustrated by the arc arrow in FIG. 33 and thus can self-adapt to constitute a supporting plane together with the two bottom elastic pads 62, forming a stable supporting construction for the table top. The illumination assembly 74 may move to leave a space for the expanded T-shaped frame 59 of the telescopic supporting frame 70 but still stay on the bottom of the table top. The rocker locking knob 81 and the rocker seat 79 are connected in the axial direction so that the swinging of the rocker 68 about the axis "BB" in the radial direction can be prevented by threads. The link lever adjusting sliding block 86 matches and slides in a groove on the right of the table top 1 horizontally. A forward or backward change in the position of the link lever adjusting sliding block 86 is able to change the relative angular relationship between the mouse plate assembly 52 and the table top 1.

Figure 32:
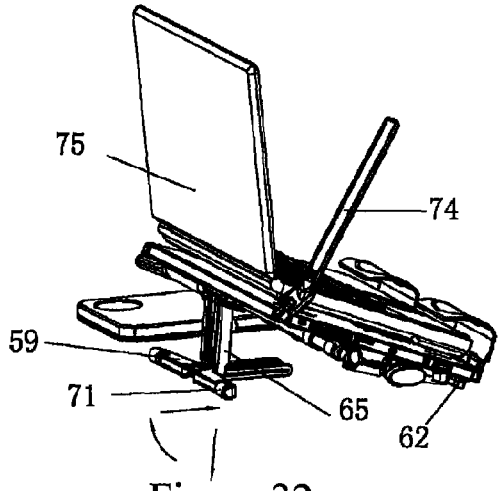
FIGS. 32, 33 and 34 are perspective views showing a telescopic supporting frame is in a supporting state of lower position.

As shown in FIG. 32, a notebook computer 75 is placed on the table top. Another supporting manner of the T-shaped frame 59 and the cage 65 can also change the supporting height of the table top. The illumination assembly 74 has been rotated to an approximately vertical position away from the bottom of the table top and occupies a smaller lateral space so as to be suitable for various applications.

Figure 34:
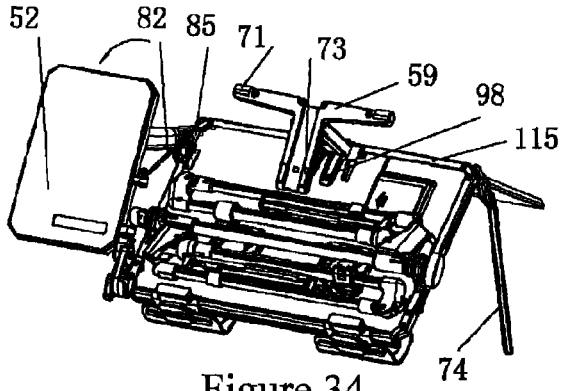
Figure 35:
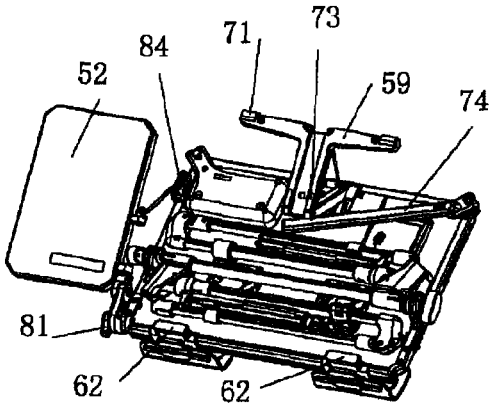
FIGS. 35, 36 and 37 are perspective views showing a T-shaped supporting frame is in a supporting state of higher position.
Figure 45:
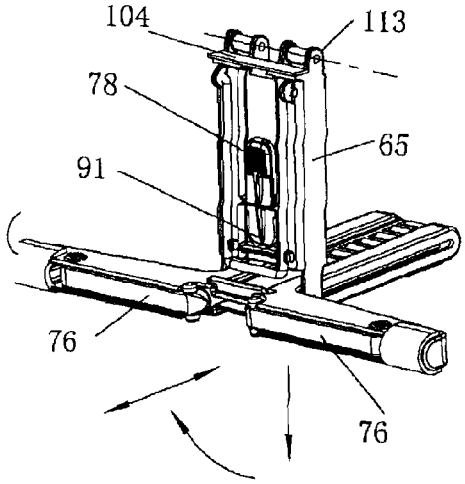
Figure 54:
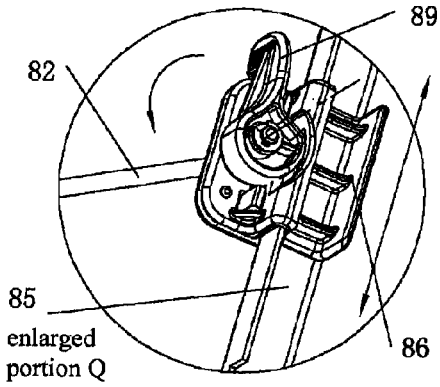
FIG. 54 is a partial enlarged view of the portion Q in FIG. 53.

As shown in FIG. 34, which shows the details of the bottom of the T-shaped frame 59, a fixed supporting base 98 is fixed to the back surface of the table top 1 and hinged to the cage 65. Referring to FIG. 45, non-circular bodies 113 at the hinged end of the cage contact the fixed supporting base 98 so as to have functions of elastically positioning and boosting in force during the telescopic supporting frame 70 assembly is turned over. Elastic pads 114 are positioned against the bending edge 115 in the upper portion of the table top when the telescopic supporting frame 70 assembly is turned over to its limit so that the turning-over angle of the telescopic supporting frame 70 assembly is limited. As shown in FIG. 45, the mouse plate assembly 52 has been in an unused state where the mouse plate assembly 52 is in parallel to the table top 1. As shown in FIG. 54, the link lever 82 controls the angle of the mouse plate assembly 52, so as to restrict the angle in the direction illustrated by an arc arrow of the portable hard disk case which is not shown in FIG. 54.

Figure 36:
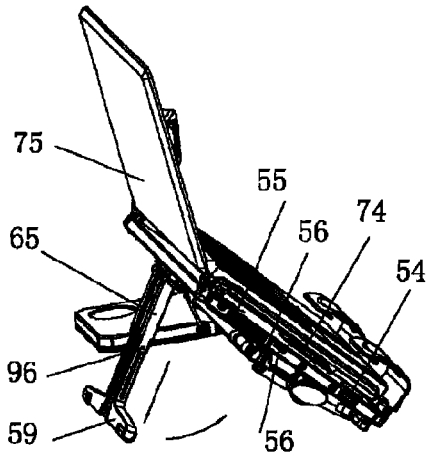
Figure 42:
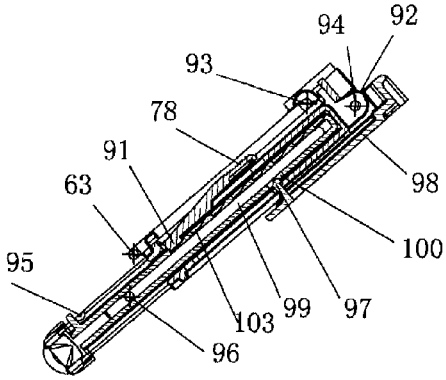
FIG. 42 is a section view of the telescopic supporting frame.

As shown in FIG. 36, the notebook computer 75 is placed on the table top. The T-shaped frame 59 is not completely pulled out of the cage 65 and keeps parallel with the cage 65 through a suitable sliding length and the restraint of a pin 99, forming a "T state" with the maximum height and thus further changing the supporting height of the table top. As shown in FIG. 42, the upper end of the T-shaped frame 59 is still clamped in the cage 65, and a catched block 91 is catched in one of the catching notches 103 and may be adjusted in height. The illumination assembly 74 is rotated to a position above the table top and on the left of the table top. The illumination assembly 74 together with the fan switch 56, the fan speed regulating knob 56, the USB ports 55 and the external power input socket, stays on the left to the user to facilitate operation.

As shown in FIGS. 37 and 55, the T-shaped supporting frame 59 is extracted, and the supporting pad 71 has a semi-circular shape so as to be suitable for a contact in an adjustable range between the T-shaped supporting frame 59 and the desktop and has an anti-slip function. Furthermore, the speaker assembly 67 has been turn over and exposes to the outside. The rotating angle of the rocker 68 relative to the rocker fixing seat 79 may be fixed and thus be restricted after the rocker 68 and the rocker fixing seat 79 are pressed axially by the rocker locking knob 81. Thus, the mouse plate assembly 52 can only swing about an axis "CC" to change the angle relative to the table top in forward and backward directions.

Figure 39:
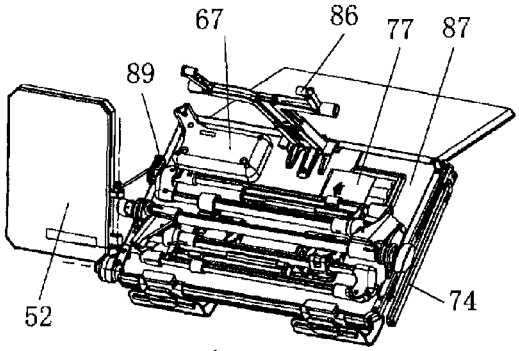
Figure 53:
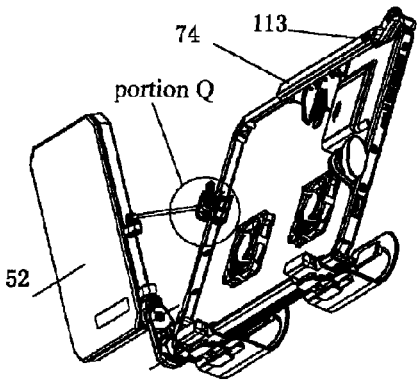
FIG. 53 is a perspective view showing the relative positioning relationship between the mouse plate assembly and a table top.

As shown in FIGS. 39, 53 and 54, two claws 76 are hid in the T-shaped bottom of the T-shaped supporting frame 59.

When the T-shaped supporting frame 59 is extracted, two claws 76 expand outward. Thus, the total height of the T-shaped supporting frame 59 increases again, which further changes the inclination angle of the table top, and thus the notebook computer relative to the desktop. The mouse plate assembly 52 swings about the axis "CC". Therefore, the restriction performed by the link lever 82 on the angle in the forward and backward directions of the mouse plate assembly 52 relative to the table top 1 is changed, and the position of the link lever adjusting sliding block 86 on the link lever 82 relative to a U-shaped guiding rail 85 formed through bending the side of the table top 1 and the rotating angle of the rocker 68 relative to the table top are changed. Thus, the mouse plate assembly 52 may achieve various angles and positions in the forward and backward directions relative to the table top. The link lever locking handle 89 is provided on the link lever adjusting sliding block 86 and can fix the sliding position of the link lever adjusting sliding block 86.

As shown in FIG. 39, which is a perspective view, an anti-slip pad is also provided on the bottom of the claws 76 of the T-shaped supporting frame 59. A battery case lid 77 of the self-contained battery case 87 opens so that three to four batteries at 4.5-6V may be contained in the battery case 87. A Hub circuit board is mounted in the case. The USB ports 55, the socket 56 for connecting external power and the fan speed regulating knob 53 are connected to the Hub circuit board.

As shown in FIG. 40, which is an enlarged perspective view of the portion "Z" of FIG. 26, the leaf springs for clamping book pages 61, which are positioned to be symmetrical to one another on the left and right respectively, are hinged to an axle "DD" on the sliding seat 58 and may be rotated around the axle "DD". A spring may be installed onto the hinge axle so that the leaf springs for clamping book pages 61 can restore its initial position in a single direction. It can be also seen from FIG. 40 that the hand-rest 57 is fitted in the lower T-shaped groove of the sliding seat 58.

Figure 56:
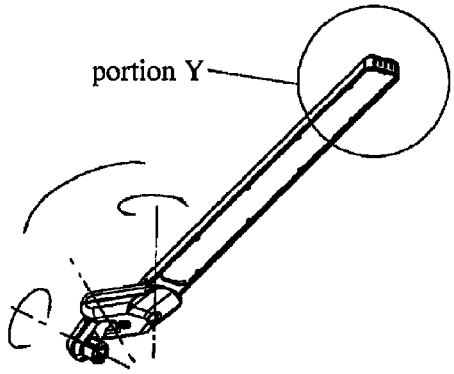
FIG. 56 is a structure schematic view of the illumination assembly.
Figure 57:
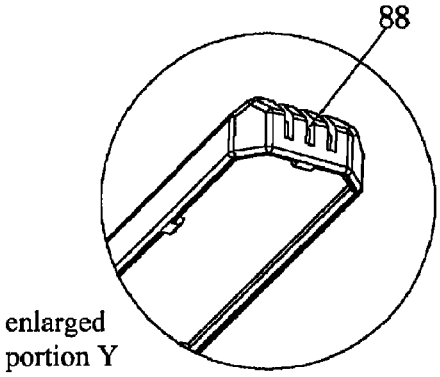
FIG. 57 is a partial enlarged view of the portion Y in FIG. 57.

As shown in FIGS. 41, 50, 51 and 52, the leaf springs for clamping book pages 61 are rotated around the axle "DD" and the sliding seats 58 move to the left and right in the direction illustrated by linear arrows so as to adjust the position of a book. As shown in FIGS. 56 and 57, the microphone 88 is integrated at the tip of the illuminator, a camera 84 is provided in the upper portion in the middle of the speaker, and a convex mirror 72 is provided in the lower portion in the middle of the speaker. With the convex mirror 72, the user can observe the scene in his or her back. The speaker assembly 67 has three degrees of freedom to allow its over-turning forward and backward to be hid in the back of the table top 1. A plane mirror 109 is mounted on the back surface of the speaker, and a concave mirror may be provided at the speaker cone.

Figure 46:
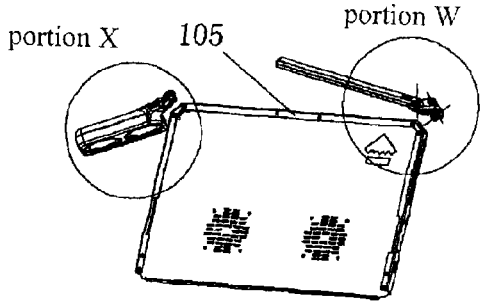
Figure 47:
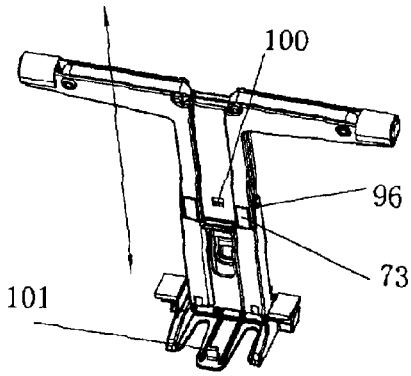
FIGS. 47, 48 and 49 are perspective views showing the speaker and the illuminator, etc. are in an expanded state.

As shown in FIG. 42, which is a section view of the telescopic supporting frame 70, a depression 95 is provided on the T-shaped frame 59, cooperates with the side frame 63, and is used when the telescopic supporting frame 70 in the supporting state of lower position. The side frame 63, through its rotating axle 93, is suspended at the cage 65. The T-shaped supporting frame 59 is movably connected to the cage through a pin 96 which slides in a groove 99 on the T-shaped supporting frame 59. The cached block 91 is provided at the lower end of a locking member 78 on the cage 65, and a series of catching notches 103 are provided along the T-shaped supporting frame 59. The catched block 91 engages into one of the catching notches 103, serving to fix the pulling length during pulling the T-shaped supporting frame 59 upward and downward. When the locking member 78 is pressed down, the catched block 91 raises and thus the T-shaped supporting frame 59 may slide upward and downward. When the locking member 78 is loosened, the T-shaped supporting frame 59 is clamped. When the T-shaped supporting frame 59 is pulled downward to its limit, since the upper section of the T-shaped supporting frame 59 has been in the opening of the lower section of the cage 65 and thus is restrained only by the pin 96, the T-shaped supporting frame 59 may be rotated, in particular around the pin 96. Thus, a combination state in a T-shape or triangle shape is formed in the side view, and the supporting height and angle of the table top 1 are changed. In FIG. 42, the cage is connected to the fixed supporting base 98 through a rotating axle 94, and the end of the cage 65 hinged to the fixed supporting base 98 has a non-circular shape and forms a tight-fit with the fixed supporting base 98, which may serve to elastically fix the rotation of the cage. As shown in FIG. 46, a latching clamp 97 on the fixed supporting base 98 forms a tight-fit with an opening 100 on the telescopic supporting frame 70, which may fix the telescopic supporting frame 70 after folded.

Figure 48:
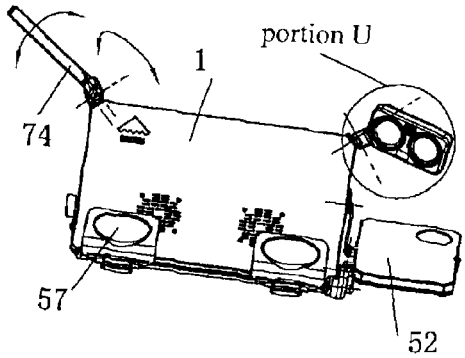
Figure 49:
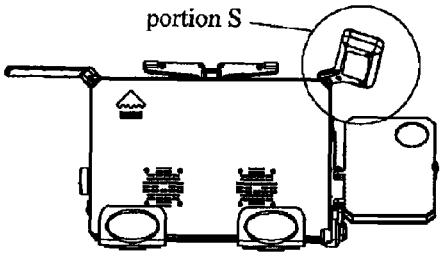
Figure 50:
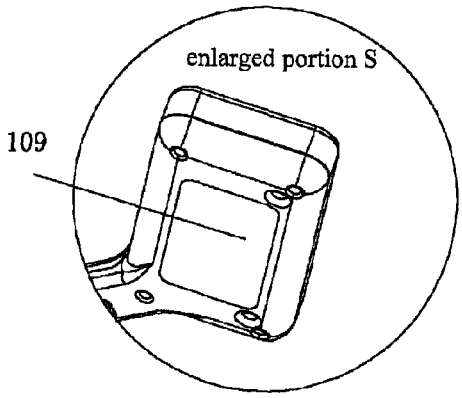
FIGS. 50, 51 and 52 are partial enlarged perspective views of the speaker assembly.
Figure 51:
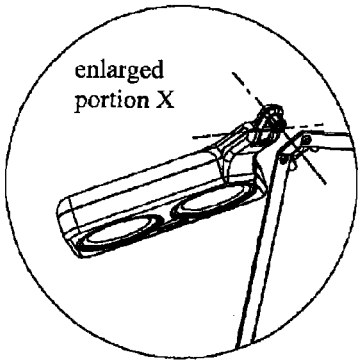
Figure 52:
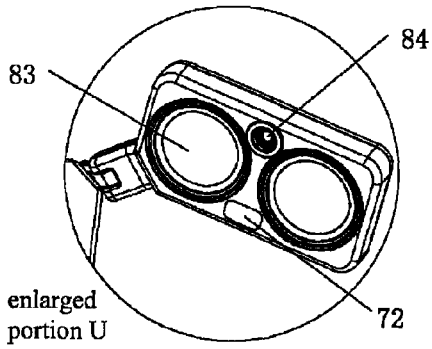

FIGS. 43, 44, 45 and 46 show different states of the telescopic supporting frame 70. The side frame 63 cooperates with the depression 95 on the T-shaped frame 59. An elastic pad 104 in the upper section of the cage 65 may fix the telescopic supporting frame 70 when the telescopic supporting frame 70 is expanded and then abuts against the edge 115 of the table top. FIGS. 48 and 49 are perspective views in which the states of the speaker and illuminator in the expanded state are shown respectively.

EXAMPLE 6

Figure 58:
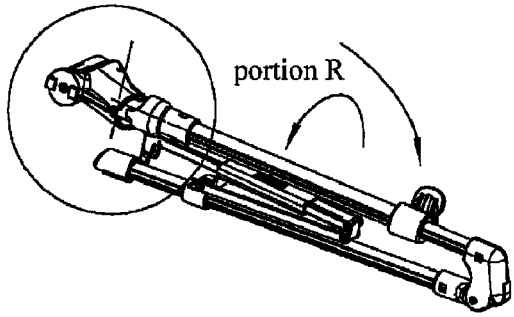
FIG. 58 is a structure schematic view showing a connection between a foldable supporting frame and an angular coupler according to Example 6.
Figure 59:
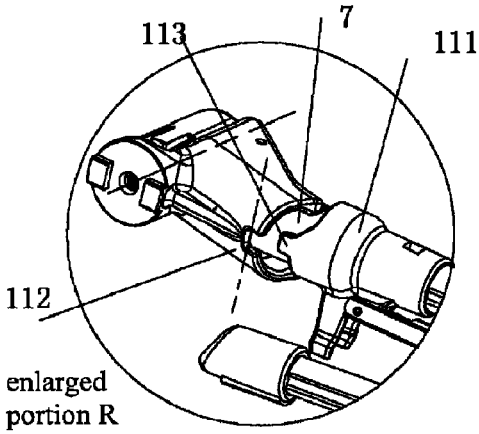
FIG. 59 is a partial enlarged view of the portion R in FIG. 58.
Figure 60:
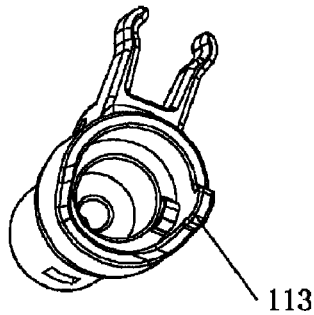
FIG. 60 is a partial enlarged view of a spinning coupler.

FIGS. 58, 59 and 60 schematically show the connection between a foldable supporting frame and an angular coupler in the present example. FIG. 59 is an enlarged view of the portion R in FIG. 58. The present example differentiates from Example 1 in that the structure of the angular coupler, a spinning coupler and a top hook coupler are improved slightly. In the present example, a rectangular projection 113 is provided on the upper end of the spinning coupler 111 and cooperates with a rectangular opening on the angular coupler 112. A jut is provided on the lower end face of the top hook coupler 7 and serves to provide guidance and fixing during rotation, in particular, to elastically guide the left or right foldable supporting frame when expanded and effectively fix the angle of a bottom tube 9 of the foldable supporting frame through the engagement of the rectangular projection 113 into the rectangular opening of the angular coupler 112.

While the present invention has been described in combination with specific preferred examples hereinabove, the present invention is not limited thereto. It will be apparent to those skilled in the art of the present invention that several simple deductions or substitutions may be made without departing from the scope of the spirit of the invention and shall be construed to fall within the scope of the present invention.

The invention claimed is:

1. A foldable table for a notebook computer, comprising a table top (1), a cross beam tube (4) and a pair of foldable supporting frames (2, 3) provided at left and right ends of the cross beam tube (4), wherein the cross beam tube (4) is movably and co-axially connected to a pair of lugs which are fixedly connected to the table top (1) through a pair of knobs provided at ends thereof, so that an angle of the table top (1) relative to an axis of the cross beam tube (4) can be adjusted;

each of the pair of foldable supporting frames comprises a foldable side, a telescopic side and a bottom tube (9), the foldable side comprises an upper foldable rod (11) and a lower foldable rod (12) which are hinged to each other, the telescopic side comprises an inner sleeving (17) and an outer sleeving (16) in which the inner sleeving (17) is slidably or fixedly accepted; the upper foldable rod (11) is hinged to an upper end of the telescopic side at an upper end thereof, the lower foldable rod (12) is hinged to the bottom tube (9) at a lower end thereof; a top hook coupler (7) is provided at the upper end portion of the telescopic side of each of the pair of foldable supporting frames, angular couplers (6) are installed at either end of the cross beam tube (4), respectively, the top hook coupler (7) is hinged to the respective one of the angular coupler (6) and can be locked therewith, at least one of the angular couplers (6) is movably connected to the cross beam tube; the upper foldable rod (11) and the lower foldable rod (12) are configured to form a rigid connection, the length of the inner sleeving (17) or outer sleeving (16) of the telescopic side is adjustable, and the bottom tube is used as a supporting side, so that the height of each of the pair of foldable supporting frames is adjustable.

2. The foldable table of claim 1, wherein each of the pair of foldable sides further comprises a hinge block (15) and a sliding sleeve (13), the hinge block (15) is hinged between the upper foldable rod (11) and lower foldable rod (12), the sliding sleeve (13) movably covers interconnections of the upper foldable rod (11), lower foldable rod (12) and hinge block (15) so that the upper foldable rod (11) and the lower foldable rod (12) form a rigid connection.

3. The foldable table of claim 2, wherein an arcuate or circular axle (8) is provided in each of the angular couplers (6) and hinged to the top hook coupler (7), the angular couplers (6) each has a C-shaped groove, the top hook coupler (7) forms a tight-fit with the C-shaped groove, and the top hook coupler (7) is locked in the C-shaped groove by an elastic strain of the C-shaped groove.

4. The foldable table of claim 2, wherein each of the pair of foldable supporting frames (2, 3) further comprises at least one intermediate foldable rod (47) hinged between the hinge block (15) and the lower foldable rod (12).

5. The foldable table of claim 2, wherein the foldable table further comprises a telescopic supporting frame (70) mounted on a back surface of the table top, the telescopic supporting frame (70) comprises a fixed supporting base (98), a cage (65) and a supporting frame (59), the fixed supporting base (98) is fixedly mounted on the back surface of the table top, the cage (65) is hinged to the fixed supporting base (98), a guiding rail or a guiding groove is provided on the supporting frame (59), a corresponding guiding rail or a corresponding guiding groove for cooperating with the supporting frame (59) is provided on the cage (65), a locking member (78) is provided on the cage (65), a catching notch (103) is provided on the supporting frame (59), the locking member (78) has a catched block (91), the catched block (91) is clamped in the catching notch (103) so as to lock the position of the cage (65) relative to the supporting frame (59).

6. The foldable table of claim 2, wherein the foldable table further comprises a telescopic supporting frame (70) mounted on a back surface of the table top, the telescopic supporting frame (70) comprises a fixing supporting base (98), a cage (65) and a supporting frame (59), the fixing supporting base (98) is fixedly provided on the back surface of the table top, the cage (65) is hinged to the fixing supporting base (98), a pin or a guiding groove is provided on the supporting frame (59), a corresponding pin or a corresponding guiding groove for cooperating with the supporting frame (59) is provided on the cage (65), a locking member (78) is provided on the cage (65), a catching notch (103) is provided on the supporting frame (59), the locking member (78) has a catched block (91), the catched block (91) is clamped in the catching notch (103) so as to lock the position of the cage (65) relative to the supporting frame (59).

7. The foldable table of claim 2, wherein the foldable table further comprises a battery case mounted on the back surface of the table top and a heat dissipating fan mounted on the back surface of the table top, heat dissipating openings are provided in an interface between the table top and the heat dissipating fan.

8. The foldable table of claim 1, wherein an arcuate or circular axle (8) is provided in each of the angular couplers (6) and hinged to the top hook coupler (7), the angular couplers (6) each has a C-shaped groove, the top hook coupler (7) forms a tight-fit with the C-shaped groove, and the top hook coupler (7) is locked in the C-shaped groove by an elastic strain of the C-shaped groove.

9. The foldable table of claim 1, wherein each of the pair of foldable supporting frames further comprises a spinning coupler (21), a fitting spindle (37) and an end surface spring (38), the fitting spindle (37) is fixedly connected to the top hook coupler (7), the telescopic side is fixedly connected to the spinning coupler at the upper end portion thereof, the fitting spindle (37) is movably connected to the spinning coupler (21) by the end surface spring (38), the upper foldable rod (11) is hinged to the spinning coupler at the upper end portion thereof, the spinning coupler (21) is co-axial with the top hook coupler (7), can move in an axial direction with respect to the top hook coupler (7) and can be rotatably positioned in a radial direction with respect to the top hook coupler (7).

10. The foldable table of claim 1, wherein the foldable table further comprises a mouse plate assembly (52) movably connected to a side of the table top (1), the mouse plate assembly (52) is overlapped onto the table top (1) in a folded state and is positioned adjacent to the side of the table top (1) in use, and a surface for supporting a mouse is coplanar with the table top (1) or is angled relative to the table top (1).

11. The foldable table of claim 10, wherein the mouse plate assembly (52) comprises a case (60), a link lever (82), a link lever locking handle (89), a link lever adjusting sliding block (86), a universal joint (80), a rocker (68) and a rocker locking knob (81), the link lever (82) is movably connected to a side of the case (60) at one end thereof and is movably connected to the link lever adjusting block (86) through the link lever locking handle (89) at the other end thereof, the link lever adjusting sliding block (86) is movably mounted at the side of the table top, and one end of the rocker (68) is movably connected to the side of the table top through the rocker locking knob (81) and the other end of the rocker (68) is movably connected to the side of the case (60) through the universal joint (80).

12. The foldable table of claim 1, wherein the foldable table further comprises a telescopic supporting frame (70) mounted on a back surface of the table top, the telescopic supporting frame (70) comprises a fixed supporting base (98), a cage (65) and a supporting frame (59), the fixed supporting base (98) is fixedly mounted on the back surface of the table top, the cage (65) is hinged to the fixed supporting base (98), a guiding rail or a guiding groove is provided on the supporting frame (59), a corresponding guiding rail or a corresponding guiding groove for cooperating with the supporting frame (59) is provided on the cage (65), a locking member (78) is provided on the cage (65), a catching notch (103) is provided on the supporting frame (59), the locking member (78) has a catched block (91), the catched block (91) is clamped in the catching notch (103) so as to lock the position of the cage (65) relative to the supporting frame (59).

13. The foldable table of claim 1, wherein the foldable table further comprises a telescopic supporting frame (70) mounted on a back surface of the table top, the telescopic supporting frame (70) comprises a fixing supporting base (98), a cage and a supporting frame, the fixing supporting base (98) is fixedly provided on the back surface of the table top, the cage is hinged to the fixing supporting base (98), a pin or a guiding groove is provided on the supporting frame (59), a corresponding pin or a corresponding guiding groove for cooperating with the supporting frame (59) is provided on the cage (65), a locking member (78) is provided on the cage (65), a catching notch (103) is provided on the supporting frame (59), the locking member (78) has a catched block (91), the catched block (91) is clamped in the catching notch (103) so as to lock the position of the cage (65) relative to the supporting frame (59).

14. The foldable table of claim 13, wherein the telescopic supporting frame further comprises a side frame, an upper end of the side frame is hinged to an upper end of the cage, a lower end of the side frame abuts the supporting frame in use so that a triangle is formed by the side frame, the supporting frame and the cage.

15. The foldable table of claim 1, wherein the foldable table further comprises an illumination assembly movably which is mounted at an edge of the table top and can be adjusted universally relative to the table top in an operation state.

16. The foldable table of claim 15, wherein the foldable table further comprises a battery case mounted on the back surface of the table top and USB ports provided at the edge of the table top.

17. The foldable table of claim 1, wherein the foldable table further comprises a speaker assembly which is movably mounted at an edge of the table top, the speaker assembly can be adjusted universally relative to the table top in an operation state and overlapped onto the back surface of the table top in an inoperation state.

18. The foldable table of claim 17, wherein the foldable table further comprises a battery case mounted on the back surface of the table top and USB ports provided at the edge of the table top.

19. The foldable table of claim 1, wherein the foldable table further comprises a battery case mounted on the back surface of the table top and a heat dissipating fan mounted on the back surface of the table top, heat dissipating openings are provided in an interface between the table top and the heat dissipating fan.

* * * * *